US007364276B2

(12) United States Patent
Piatt et al.

(10) Patent No.: US 7,364,276 B2
(45) **Date of Patent: *Apr. 29, 2008**

(54) CONTINUOUS INK JET APPARATUS WITH INTEGRATED DROP ACTION DEVICES AND CONTROL CIRCUITRY

(75) Inventors: Michael J. Piatt, Dayton, OH (US); Stephen F. Pond, Williamsburg, VA (US)

(73) Assignee: Eastman Kodak Company, Rochester, NY (US)

( * ) Notice: Subject to any disclaimer, the term of this patent is extended or adjusted under 35 U.S.C. 154(b) by 96 days.

This patent is subject to a terminal disclaimer.

(21) Appl. No.: 11/229,263

(22) Filed: Sep. 16, 2005

(65) Prior Publication Data

US 2007/0064068 A1 Mar. 22, 2007

(51) Int. Cl.
*B41J 2/07* (2006.01)

(52) U.S. Cl. ..... 347/74; 347/75; 347/76; 347/77; 347/81

(58) Field of Classification Search ..... None
See application file for complete search history.

(56) References Cited

U.S. PATENT DOCUMENTS

| | | | | |
|---|---|---|---|---|
| 3,373,437 A | | 3/1968 | Sweet | 347/74 |
| 3,560,641 A | * | 2/1971 | Taylor et al. | 358/296 |
| 3,596,275 A | * | 7/1971 | Sweet | 347/74 |
| 3,739,393 A | | 6/1973 | Lyon et al. | 347/75 |
| 3,769,630 A | * | 10/1973 | Hill et al. | 347/80 |
| 3,877,036 A | | 4/1975 | Loeffler et al. | 347/77 |
| 3,878,519 A | | 4/1975 | Eaton | 347/75 |
| 3,886,564 A | * | 5/1975 | Naylor et al. | 347/81 |
| 3,893,623 A | * | 7/1975 | Toupin | 239/102.2 |
| 3,907,429 A | * | 9/1975 | Kuhn et al | 356/28 |
| 3,949,410 A | | 4/1976 | Bassous et al. | |
| 3,960,324 A | * | 6/1976 | Titus et al. | 239/4 |

(Continued)

FOREIGN PATENT DOCUMENTS

EP 1 215 047 6/2002

(Continued)

*Primary Examiner*—Son Nguyen
*Assistant Examiner*—Justin Seo
(74) *Attorney, Agent, or Firm*—Stephen F. Pond; William R. Zimmerli

(57) ABSTRACT

A continuous liquid drop emission apparatus is provided. The liquid drop emission apparatus is comprised of a liquid chamber containing a positively pressurized liquid in flow communication with at least one nozzle for emitting a continuous stream of liquid and a jet stimulation apparatus adapted to transfer pulses of energy to the liquid in flow communication with the at least one nozzle sufficient to cause the break-off of the at least one continuous stream of liquid into a stream of drops of predetermined volumes. The continuous liquid drop emission apparatus further comprises a semiconductor substrate including integrated circuitry formed therein for performing and controlling a plurality of actions on the drops of predetermined volumes. The plurality of actions may include drop charging, drop sensing, drop deflection and drop capturing. Drop action apparatus adapted to perform these functions and integrated circuitry to control the drop action apparatus are formed in the semiconductor substrate. Jet stimulation apparatus comprised of a plurality of transducers including resistive heaters, electromechanical vibrators or thermomechanical vibrators, together with integrated control circuitry, may also be integrated on the semiconductor substrate. Silicon is a preferred material for the semiconductor substrate and CMOS and NMOS designs and fabrication processes are preferred for the integrated circuitry.

47 Claims, 25 Drawing Sheets

U.S. PATENT DOCUMENTS

| | | | | | |
|---|---|---|---|---|---|
| 3,984,843 | A | | 10/1976 | Kuhn | 346/75 |
| 3,992,713 | A | * | 11/1976 | Carmichael et al. | 347/80 |
| 4,047,184 | A | | 9/1977 | Bassous et al. | 347/76 |
| 4,068,241 | A | * | 1/1978 | Yamada | 347/75 |
| 4,198,643 | A | | 4/1980 | Cha et al. | 347/75 |
| 4,223,320 | A | * | 9/1980 | Paranjpe et al. | 347/76 |
| 4,255,754 | A | * | 3/1981 | Crean et al. | 347/81 |
| 4,288,801 | A | | 9/1981 | Ronen | 257/393 |
| 4,303,927 | A | | 12/1981 | Tsao | 347/40 |
| 4,344,078 | A | * | 8/1982 | Houston | 347/81 |
| 4,350,986 | A | * | 9/1982 | Yamada | 347/75 |
| 4,417,256 | A | * | 11/1983 | Fillmore et al. | 347/78 |
| 4,631,550 | A | * | 12/1986 | Piatt et al. | 347/80 |
| 4,638,325 | A | | 1/1987 | Schneider et al. | |
| 4,638,328 | A | * | 1/1987 | Drake et al. | 347/75 |
| 4,658,269 | A | * | 4/1987 | Rezanka | 347/45 |
| 4,879,565 | A | * | 11/1989 | Fujii | 347/74 |
| 4,947,192 | A | | 8/1990 | Hawkins et al. | 347/59 |
| 5,001,497 | A | * | 3/1991 | Wills et al. | 347/82 |
| 5,689,291 | A | * | 11/1997 | Tence et al. | 347/10 |
| 5,877,562 | A | * | 3/1999 | Sur et al. | 257/797 |
| 5,902,504 | A | * | 5/1999 | Merchant et al. | 438/10 |
| 5,943,588 | A | * | 8/1999 | Watrobski et al. | 438/401 |
| 5,963,235 | A | * | 10/1999 | Chwalek et al. | 347/82 |
| 6,008,060 | A | * | 12/1999 | Chang et al. | 438/7 |
| 6,012,805 | A | * | 1/2000 | Hawkins et al. | 347/82 |
| 6,053,176 | A | * | 4/2000 | Adams et al. | 131/329 |
| 6,057,206 | A | * | 5/2000 | Nguyen et al. | 438/401 |
| 6,309,058 | B1 | * | 10/2001 | Lecheheb et al. | 347/73 |
| 6,387,225 | B1 | | 5/2002 | Shimada et al. | 204/192.18 |
| 6,394,585 | B1 | * | 5/2002 | Ross | 347/54 |
| 6,402,305 | B1 | * | 6/2002 | Chwalek et al. | 347/82 |
| 6,435,645 | B1 | | 8/2002 | Falinski | 347/19 |
| 6,450,619 | B1 | | 9/2002 | Anagnostopoulos et al. | 347/59 |
| 6,474,784 | B1 | | 11/2002 | Fujii et al. | 347/54 |
| 6,474,794 | B1 | * | 11/2002 | Anagnostopoulos et al. | 347/74 |
| 6,476,928 | B1 | * | 11/2002 | Barbour et al. | 358/1.15 |
| 6,491,385 | B2 | | 12/2002 | Anagnostopoulos et al. | 347/73 |
| 6,505,921 | B2 | * | 1/2003 | Chwalek et al. | 347/77 |
| 6,509,917 | B1 | * | 1/2003 | Chwalek et al. | 347/82 |
| 6,511,161 | B2 | | 1/2003 | Sumi et al. | 347/68 |
| 6,543,107 | B1 | | 4/2003 | Miyashita et al. | 29/25.35 |
| 6,561,627 | B2 | * | 5/2003 | Jarrold et al. | 347/54 |
| 6,588,888 | B2 | | 7/2003 | Jeanmaire et al. | 347/77 |
| 6,682,182 | B2 | * | 1/2004 | Jeanmaire et al. | 347/74 |
| 6,726,318 | B2 | * | 4/2004 | Arakawa | 347/106 |
| 6,902,262 | B2 | * | 6/2005 | Tanaka et al. | 347/68 |
| 6,905,196 | B2 | * | 6/2005 | Seabridge et al. | 347/58 |
| 6,995,040 | B2 | * | 2/2006 | Patel et al. | 438/107 |
| 7,129,180 | B2 | * | 10/2006 | Sandhu et al. | 438/717 |
| 2002/0085073 | A1 | * | 7/2002 | Chwalek et al. | 347/77 |
| 2003/0016275 | A1 | * | 1/2003 | Jeanmaire et al. | 347/74 |
| 2004/0263573 | A1 | * | 12/2004 | Cabal et al. | 347/54 |
| 2005/0191790 | A1 | * | 9/2005 | Patel et al. | 438/107 |
| 2006/0164469 | A1 | * | 7/2006 | Houben | 347/73 |
| 2006/0284941 | A1 | * | 12/2006 | Murakami et al. | 347/78 |
| 2007/0064037 | A1 | * | 3/2007 | Hawkins et al. | 347/19 |

FOREIGN PATENT DOCUMENTS

| | | | | |
|---|---|---|---|---|
| FR | 2698584 | A1 | * | 6/1994 |
| FR | 2698584 | A1 | | 11/2002 |
| GB | 2036646 | A | * | 7/1980 |

* cited by examiner

CONTINUOUS INK JET APPARATUS WITH INTEGRATED DROP ACTION DEVICES AND CONTROL CIRCUITRY

CROSS REFERENCE TO RELATED APPLICATIONS

Reference is made to commonly assigned, U.S. patent application Ser. No. 11/229,454 filed concurrently herewith, entitled "INK JET BREAK-OFF LENGTH MEASUREMENT APPARATUS AND METHOD," in the name of Gilbert A. Hawkins, et al.; U.S. patent application Ser. No. 11/229,261 filed concurrently herewith, entitled "CONTINUOUS INK JET APPARATUS AND METHOD USING A PLURALITY OF BREAK-OFF TIMES," in the name of Michael J. Piatt, et al.; U.S. patent application Ser. No. 11/229,467 filed concurrently herewith, entitled "INK JET BREAK-OFF LENGTH CONTROLLED DYNAMICALLY BY INDIVIDUAL JET STIMULATION," in the name of Gilbert A. Hawkins, et al.; U.S. patent application Ser. No. 11/229,459 filed concurrently herewith, entitled "METHOD FOR DROP BREAKOFF LENGTH CONTROL IN A HIGH RESOLUTION," in the name of Michael J. Piatt et al.; and U.S. patent application Ser. No. 11/229,456 filed concurrently herewith, entitled "IMPROVED INK JET PRINTING DEVICE WITH IMPROVED DROP SELECTION CONTROL," in the name of James A. Katerberg, the disclosures of all of which are incorporated herein by reference.

FIELD OF THE INVENTION

This invention relates generally to continuous stream type ink jet printing systems and more particularly to printheads which stimulate the ink in the continuous stream type ink jet printers by individual jet stimulation apparatus, especially using thermal or microelectromechanical energy pulses.

BACKGROUND OF THE INVENTION

Ink jet printing has become recognized as a prominent contender in the digitally controlled, electronic printing arena because, e.g., of its non-impact, low-noise characteristics, its use of plain paper and its avoidance of toner transfer and fixing. Ink jet printing mechanisms can be categorized by technology as either drop on demand ink jet or continuous ink jet.

The first technology, "drop-on-demand" ink jet printing, provides ink droplets that impact upon a recording surface by using a pressurization actuator (thermal, piezoelectric, etc.). Many commonly practiced drop-on-demand technologies use thermal actuation to eject ink droplets from a nozzle. A heater, located at or near the nozzle, heats the ink sufficiently to boil, forming a vapor bubble that creates enough internal pressure to eject an ink droplet. This form of inkjet is commonly termed "thermal ink jet (TIJ)." Other known drop-on-demand droplet ejection mechanisms include piezoelectric actuators, such as that disclosed in U.S. Pat. No. 5,224,843, issued to van Lintel, on Jul. 6, 1993; thermo-mechanical actuators, such as those disclosed by Jarrold et al., U.S. Pat. No. 6,561,627, issued May 13, 2003; and electrostatic actuators, as described by Fujii et al., U.S. Pat. No. 6,474,784, issued Nov. 5, 2002.

The second technology, commonly referred to as "continuous" ink jet printing, uses a pressurized ink source that produces a continuous stream of ink droplets from a nozzle. The stream is perturbed in some fashion causing it to break up into uniformly sized drops at a nominally constant distance, the break-off length, from the nozzle. A charging electrode structure is positioned at the nominally constant break-off point so as to induce a data-dependent amount of electrical charge on the drop at the moment o break-off. The charged droplets are directed through a fixed electrostatic field region causing each droplet to deflect proportionately to its charge. The charge levels established at the break-off point thereby cause drops to travel to a specific location on a recording medium or to a gutter for collection and recirculation.

Continuous ink jet (CIJ) drop generators rely on the physics of an unconstrained fluid jet, first analyzed in two dimensions by F. R. S. (Lord) Rayleigh, "Instability of jets," Proc. London Math. Soc. 10 (4), published in 1878. Lord Rayleigh's analysis showed that liquid under pressure, P, will stream out of a hole, the nozzle, forming a jet of diameter, $d_j$, moving at a velocity, $v_j$. The jet diameter, $d_j$, is approximately equal to the effective nozzle diameter, $d_n$, and the jet velocity is proportional to the square root of the reservoir pressure, P. Rayleigh's analysis showed that the jet will naturally break up into drops of varying sizes based on surface waves that have wavelengths, $\lambda$, longer than $\pi d_j$, i.e. $\lambda \geqq \pi d_j$. Rayleigh's analysis also showed that particular surface wavelengths would become dominate if initiated at a large enough magnitude, thereby "synchronizing" the jet to produce mono-sized drops. Continuous ink jet (CIJ) drop generators employ some periodic physical process, a so-called "perturbation" or "stimulation", that has the effect of establishing a particular, dominate surface wave on the jet. This results in the break-off of the jet into mono-sized drops synchronized to the frequency of the perturbation.

The drop stream that results from applying a Rayleigh stimulation will be referred to herein as creating a stream of drops of predetermined volume. While in prior art CIJ systems, the drops of interest for printing or patterned layer deposition were invariably of unitary volume, it will be explained that for the present inventions, the stimulation signal may be manipulated to produce drops of predetermined multiples of the unitary volume. Hence the phrase, "streams of drops of predetermined volumes" is inclusive of drop streams that are broken up into drops all having one size or streams broken up into drops of planned different volumes.

In a CIJ system, some drops, usually termed "satellites" much smaller in volume than the predetermined unit volume, may be formed as the stream necks down into a fine ligament of fluid. Such satellites may not be totally predictable or may not always merge with another drop in a predictable fashion, thereby slightly altering the volume of drops intended for printing or patterning. The presence of small, unpredictable satellite drops is, however, inconsequential to the present inventions and is not considered to obviate the fact that the drop sizes have been predetermined by the synchronizing energy signals used in the present inventions. Thus the phrase "predetermined volume" as used to describe the present inventions should be understood to comprehend that some small variation in drop volume about a planned target value may occur due to unpredictable satellite drop formation.

Commercially practiced CIJ printheads use a piezoelectric device, acoustically coupled to the printhead, to initiate a dominant surface wave on the jet. The coupled piezoelectric device superimposes periodic pressure variations on the base reservoir pressure, causing velocity or flow perturbations that in turn launch synchronizing surface waves. A pioneering disclosure of a piezoelectrically-stimulated CIJ apparatus was made by R. Sweet in U.S. Pat. No. 3,596,275, issued Jul. 27, 1971, Sweet '275 hereinafter. The CIJ apparatus disclosed by Sweet '275 consisted of a single jet, i.e. a single drop generation liquid chamber and a single nozzle structure.

Sweet '275 disclosed several approaches to providing the needed periodic perturbation to the jet to synchronize drop break-off to the perturbation frequency. Sweet '275 discloses a magnetostrictive material affixed to a capillary nozzle enclosed by an electrical coil that is electrically driven at the desired drop generation frequency, vibrating the nozzle, thereby introducing a dominant surface wave perturbation to the jet via the jet velocity. Sweet '275 also discloses a thin ring-electrode positioned to surround but not touch the unbroken fluid jet, just downstream of the nozzle. If the jetted fluid is conductive, and a periodic electric field is applied between the fluid filament and the ring-electrode, the fluid jet may be caused to expand periodically, thereby directly introducing a surface wave perturbation that can synchronize the jet break-off. This CIJ technique is commonly called electrohydrodynamic (EHD) stimulation.

Sweet '275 further disclosed several techniques for applying a synchronizing perturbation by superimposing a pressure variation on the base liquid reservoir pressure that forms the jet. Sweet '275 disclosed a pressurized fluid chamber, the drop generator chamber, having a wall that can be vibrated mechanically at the desired stimulation frequency. Mechanical vibration means disclosed included use of magnetostrictive or piezoelectric transducer drivers or an electromagnetic moving coil. Such mechanical vibration methods are often termed "acoustic stimulation" in the CIJ literature.

The several CIJ stimulation approaches disclosed by Sweet '275 may all be practical in the context of a single jet system However, the selection of a practical stimulation mechanism for a CIJ system having many jets is far more complex. A pioneering disclosure of a multi-jet CIJ printhead has been made by Sweet et al. in U.S. Pat. No. 3,373,437, issued Mar. 12, 1968, Sweet '437 hereinafter. Sweet '437 discloses a CIJ printhead having a common drop generator chamber that communicates with a row (an array) of drop emitting nozzles. A rear wall of the common drop generator chamber is vibrated by means of a magnetostrictive device, thereby modulating the chamber pressure and causing a jet velocity perturbation on every jet of the array of jets.

Since the pioneering CIJ disclosures of Sweet '275 and Sweet '437, most disclosed multi-jet CIJ printheads have employed some variation of the jet break-off perturbation means described therein. For example, U.S. Pat. No. 3,560,641 issued Feb. 2, 1971 to Taylor et al. discloses a CIJ printing apparatus having multiple, multi-jet arrays wherein the drop break-off stimulation is introduced by means of a vibration device affixed to a high pressure ink supply line that supplies the multiple CIJ printheads. U.S. Pat. No. 3,739,393 issued Jun. 12, 1973 to Lyon et al. discloses a multi-jet CIJ array wherein the multiple nozzles are formed as orifices in a single thin nozzle plate and the drop break-off perturbation is provided by vibrating the nozzle plate, an approach akin to the single nozzle vibrator disclosed by Sweet '275. U.S. Pat. No. 3,877,036 issued Apr. 8, 1975 to Loeffler et al. discloses a multi-jet CIJ printhead wherein a piezoelectric transducer is bonded to an internal wall of a common drop generator chamber, a combination of the stimulation concepts disclosed by Sweet '437 and '275

Unfortunately, all of the stimulation methods employing a vibration some component of the printhead structure or a modulation of the common supply pressure result is some amount of non-uniformity of the magnitude of the perturbation applied to each individual jet of a multi-jet CIJ array. Non-uniform stimulation leads to a variability in the break-off length and timing among the jets of the array. This variability in break-off characteristics, in turn, leads to an inability to position a common drop charging assembly or to use a data timing scheme that can serve all of the jets of the array. As the array becomes physically larger, for example long enough to span one dimension of a typical paper size (herein termed a "page wide array"), the problem of non-uniformity of jet stimulation becomes more severe. Non-uniformity in jet break off length across a multi-jet array causes unpredictable drop arrival times leading to print quality defects in ink jet printing systems and ragged layer edges or misplaced coating material for other uses of CIJ liquid drop emitters.

Many attempts have been made to overcome the problem of non-uniform CIJ stimulation based on vibrating structures. U.S. Pat. No. 3,960,324 issued Jun. 1, 1976 to Titus et al. discloses the use of multiple, discretely mounted, piezoelectric transducers, driven by a common electrical signal, in an attempt to produce uniform pressure stimulation at the nozzle array. U.S. Pat. No. 4,135,197 issued Jan. 16, 1979 to L. Stoneburner discloses means of damping reflected acoustic waves set up in a vibrated nozzle plate. U.S. Pat. No. 4,198,643 issued Apr. 15, 1980 to Cha, et al. disclosed means for mechanically balancing the printhead structure so that an acoustic node occurs at the places where the printhead is clamped for mounting. U.S. Pat. No. 4,303,927 issued Dec. 1, 1981 to S. Tsao discloses a drop generator cavity shape chosen to resonate in a special mode perpendicular to the jet array direction, thereby setting up a dominate pressure perturbation that is uniform along the array.

U.S. Pat. No. 4,417,256 issued Nov. 22, 1983 to Fillmore, et al., (Fillmore '256 hereinafter) discloses an apparatus and method for balancing the break-off lengths in a multi-jet array by sensing the drop streams and then adjusting the magnitude of the excitation means to adjust the spread in break-off lengths. Fillmore '256 teaches that for the case of a multi-jet printhead driven by a single piezoelectric "crystal", there is an optimum crystal drive voltage that minimizes the break-off length for each individual jet in the array. The jet break-off lengths versus crystal drive voltage are determined for the "strongest" and "weakest" jets, in terms of stimulation efficiency. An operating crystal voltage is then selected that is in between optimum for the weakest and strongest jets, that is, higher than the optimum voltage of the strongest jet and lower than optimum voltage for the weakest jet. Fillmore '256 does not contemplate a system in which the break-off lengths could be adjusted to a desired operating length by means of stimulation means that are separately adjustable for each stream of the array.

Many other attempts to achieve uniform CIJ stimulation using vibrating devices, similar to the above references, may be found in the U.S. patent literature. However, it appears that the structures that are strong and durable enough to be operated at high ink reservoir pressures contribute confounding acoustic responses that cannot be totally eliminated in the range of frequencies of interest. Commercial CIJ systems employ designs that carefully manage the acoustic behavior of the printhead structure and also limit the magnitude of the applied acoustic energy to the least necessary to achieve acceptable drop break-off across the array. A means of CIJ stimulation that does not significantly couple to the printhead structure itself would be an advantage, especially for the construction of page wide arrays (PWA's) and for reliable operation in the face of drifting ink and environmental parameters.

The electrohydrodynamic (EHD) jet stimulation concept disclosed by Sweet '275 operates on the emitted liquid jet filament directly, causing minimal acoustic excitation of the printhead structure itself, thereby avoiding the above noted confounding contributions of printhead and mounting structure resonances. U.S. Pat. No. 4,047,184 issued Sep. 6, 1977 to E. Bassous and L. Kuhn (Bassous '184 hereinafter) discloses a CIJ printhead wherein the perturbation is accomplished an EHD exciter that is integrated on a silicon substrate on which nozzles are also formed by a combination of orientation dependent etching (ODE) of silicon and isotropic etching of an oxide or nitride membrane. Bassous '184 also discloses the integration of nozzles, EHD stimulator and drop charging electrodes formed concentrically and aligned in a direction perpendicular to the silicon substrate. L. Kuhn, in U.S. Pat. No. 3,984,843 (Kuhn '843 hereinafter) issued Oct. 5, 1976, discloses the use of a separate silicon substrate to form a charging electrode and also shift register and latch circuits integrated with the charging electrodes on this same substrate. Because of the perpendicular arrangement of these functions, and the ODE etching approach taught by Bassous '184, only rather large minimum jet spacing, ~16 mils are practical.

Bassous '184 and Kuhn '843 teach, within the limitation of EHD stimulation, an early form of the integration of continuous ink jet functions and some related circuitry into a common semiconductor substrate over which the inventions to be described herein are a significant improvement. However, while EHD stimulation has been pursued as an alternative to acoustic stimulation, it has not been applied commercially because of the difficulty in fabricating printhead structures having the very close jet-to-electrode spacing required and, then, operating reliably without electrostatic breakdown occurring. Also, due to the relatively long range of electric field effects, EHD is not amenable to providing individual stimulation signals to individual jets in an array of very closely spaced jets.

French Patent Application 2,698,584 to J. Ballard, filed Nov. 30, 1992, discloses, the use of a silicon substrate to form drop capturing or guttering openings on a per jet basis. The patent application also discloses but does not explain a set of deflection electrodes, one for each jet, formed on the same silicon substrate. No integration of drop charging or deflection circuitry is disclosed and the fabrication discussion only concerns the formation of drop capture features having various geometries. No specific technical approach to providing jet break-up stimulation is given.

An alternate jet perturbation concept that overcomes all of the drawbacks of acoustic or EHD stimulation was disclosed for a single jet CIJ system in U.S. Pat. No. 3,878,519 issued Apr. 15, 1975 to J. Eaton (Eaton hereinafter). Eaton discloses the thermal stimulation of a jet fluid filament by means of localized light energy or by means of a resistive heater located at the nozzle, the point of formation of the fluid jet. Eaton explains that the fluid properties, especially the surface tension, of a heated portion of a jet may be sufficiently changed with respect to an unheated portion to cause a localized change in the diameter of the jet, thereby launching a dominant surface wave if applied at an appropriate frequency.

Eaton mentions that thermal stimulation is beneficial for use in a printhead having a plurality of closely spaced ink streams because the thermal stimulation of one stream does not affect any adjacent nozzle. However, Eaton does not teach or disclose any multi-jet printhead configurations, nor any practical methods of implementing a thermally-stimulated multi-jet CIJ device, especially one amenable to page wide array construction. Eaton teaches his invention using calculational examples and parameters relevant to a state-of-the-art ink jet printing application circa the early 1970's, i.e. a drop frequency of 100 KHz and a nozzle diameter of ~25 microns leading to drop volumes of ~60 picoLiters (pL). Eaton does not teach or disclose how to configure or operate a thermally-stimulated CIJ printhead that would be needed to print drops an order of magnitude smaller and at substantially higher drop frequencies.

U.S. Pat. No. 4,638,328 issued Jan. 20, 1987 to Drake, et al. (Drake hereinafter) discloses a thermally-stimulated multi-jet CIJ drop generator fabricated in an analogous fashion to a thermal ink jet device. That is, Drake discloses the operation of a traditional thermal ink jet (TIJ) edge-shooter or roofshooter device in CIJ mode by supplying high pressure ink and applying energy pulses to the heaters sufficient to cause synchronized break-off but not so as to generate vapor bubbles. Drake mentions that the power applied to each individual stimulation resistor may be tailored to eliminate non-uniformities due to cross talk. However, the inventions claimed and taught by Drake are specific to CIJ devices fabricated using two substrates that are bonded together, one substrate being planar and having heater electrodes and the other having topographical features that form individual ink channels and a common ink supply manifold.

Also recently, microelectromechanical systems (MEMS), have been disclosed that utilize electromechanical and thermomechanical transducers to generate mechanical energy for performing work. For example, thin film piezoelectric, ferroelectric or electrostrictive materials such as lead zirconate titanate (PZT), lead lanthanum zirconate titanate (PLZT), or lead magnesium niobate titanate (PMNT) may be deposited by sputtering or sol gel techniques to serve as a layer that will expand or contract in response to an applied electric field. See, for example Shimada, et al. in U.S. Pat. No. 6,387,225, issued May 14, 2002; Sumi, et al., in U.S. Pat. No. 6,511,161, issued Jan. 28, 2003; and Miyashita, et al., in U.S. Pat. No. 6,543,107, issued Apr. 8, 2003. Thermomechanical devices utilizing electroresistive materials that have large coefficients of thermal expansion, such as titanium aluminide, have been disclosed as thermal actuators constructed on semiconductor substrates. See, for example, Jarrold et al., U.S. Pat. No. 6,561,627, issued May 13, 2003. Therefore electromechanical devices may also be configured and fabricated using microelectronic processes to provide stimulation energy on a jet-by-jet basis.

The application of thermal or microelectromechanical stimulation facilitates the further use of microelectronic design and fabrication technologies to provide local electronic circuitry and other local transducers to perform other functions needed in a continuous liquid drop emitter system. The power drive transistors needed to provide stimulation energy may be integrated in a semiconductor substrate in which are formed the stimulation devices. The integration of stimulation driver circuitry is described in U.S. Pat. Nos. 6,450,619; 6,474,794; and 6,491,385 to Anagnostopoulos, et al., assigned to the assignees of the present inventions.

After stimulation to synchronize jet break-up into a drop stream, a continuous liquid drop emitter apparatus performs several actions on the drops in order to separate drops intended to form the pattern or image on the receiver from those that are "white space", spacer or drop interaction guard drops. The drop actions that may be needed include drop charging, drop sensing, drop deflection along two non-parallel axes, and drop capture. For a liquid drop emitter having many jets, these various drop actions may be carried out by apparatus that acts on all drops of all jets simultaneously, acts on the drops of groups of jets, or acts on the drops of only a single jet.

It may be appreciated that the combination of several drop actions and a large plurality of jets will quickly lead to a very complex array of supporting electronic circuitry and interconnections if one attempts to implement all drop actions on a jet-by-jet basis. On the other hand, implementation of a plurality of the drop actions on a jet-by-jet basis allows the adjustment of drop trajectories and placement on receiver substrates with maximum precision and is highly desirable for both achieving high quality deposition patterns and improved drop emitter manufacturing yield through post-fabrication electronic personalization techniques.

Significant manufacturing cost and pattern deposition quality advances for continuous liquid drop emission apparatus are possible by applying state-of-the art microelectronic design, circuitry and fabrication techniques to both the stream stimulation functions and the various drop actions that are subsequently needed. Integration of the functional apparatus and associated control electronic circuitry on a same semiconductor substrate offers very significant cost advantages by co-fabrication of critical transducer elements and circuitry, and elimination of very difficulty precision assembly and interconnection requirements.

SUMMARY OF THE INVENTION

It is therefore an object of the present invention to provide a continuous liquid drop emission apparatus that advantageously employs the characteristics of individual jet thermal stimulation for a traditional charged-drop CIJ system.

It is an object of the present invention to provide a continuous liquid drop emission apparatus that advantageously employs the characteristics of microelectromechanical stimulation of individual jets for a traditional charged-drop CIJ system.

It is also an object of the present invention to provide a continuous liquid drop emission apparatus that integrates drop action transducers including charging, sensing, deflecting and capturing into a common semiconductor substrate.

It is also an object of the present invention to provide a continuous liquid drop emission apparatus that is cost effective by making use of electronic circuitry integration among sub-functions of the apparatus.

The foregoing and numerous other features, objects and advantages of the present invention will become readily apparent upon a review of the detailed description, claims and drawings set forth herein. These features, objects and advantages are accomplished by constructing a continuous liquid drop emission apparatus comprising a liquid chamber containing a positively pressurized liquid in flow communication with at least one nozzle for emitting a continuous stream of liquid and having a jet stimulation apparatus adapted to transfer pulses of energy to the liquid in flow communication with the at least one nozzle sufficient to cause the break-off of the at least one continuous stream of liquid into a stream of drops of predetermined volumes and a semiconductor substrate including drop action apparatus and integrated circuitry formed therein for performing and controlling a plurality of actions on the drops of predetermined volumes.

The present inventions are also configured to provide jet stimulation apparatus and at least one drop action apparatus integrated with control circuitry on a semiconductor substrate, wherein the semiconductor substrate forms a portion of a wall of a pressurized liquid chamber and the substrate extends generally in the jet.

The present inventions also provide for the integration of many combinations of microelectromechanical or thermal jet stimulation apparatus, drop charging, sensing, deflecting and capturing apparatus, CMOS and NMOS circuitry, and location features to assist the precise assembly of a liquid drop emitter having a plurality of continuous jets.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. Functional elements and features have been given the same numerical labels in the figures if they are the same element or perform the same function for purposes of understanding the present inventions. It is to be understood that elements not specifically shown or described may take various forms well known to those skilled in the art.

Figure 1A:
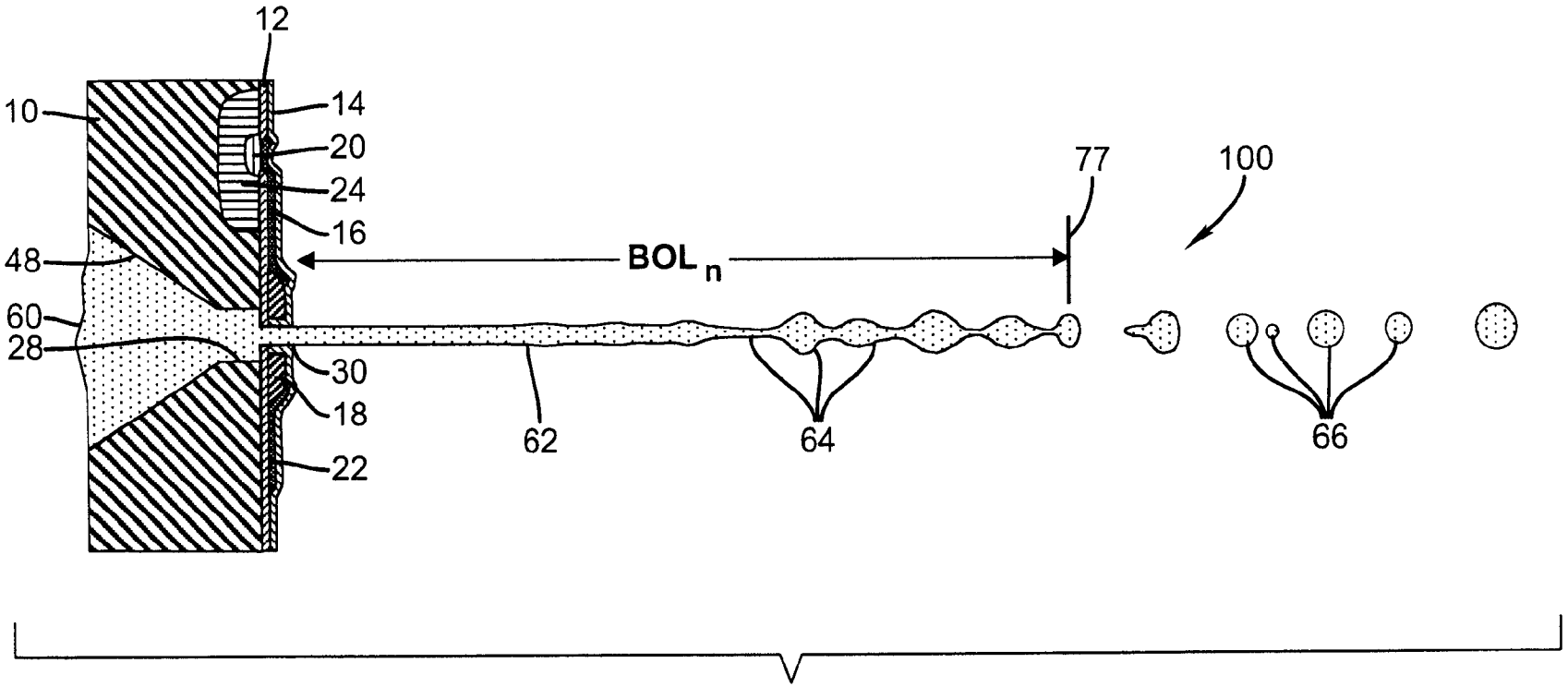
FIGS. 1(*a*) and 1(*b*) are side view illustrations of a continuous liquid stream undergoing natural break up into drops and thermally stimulated break up into drops of predetermined volumes respectively.
Figure 1B:
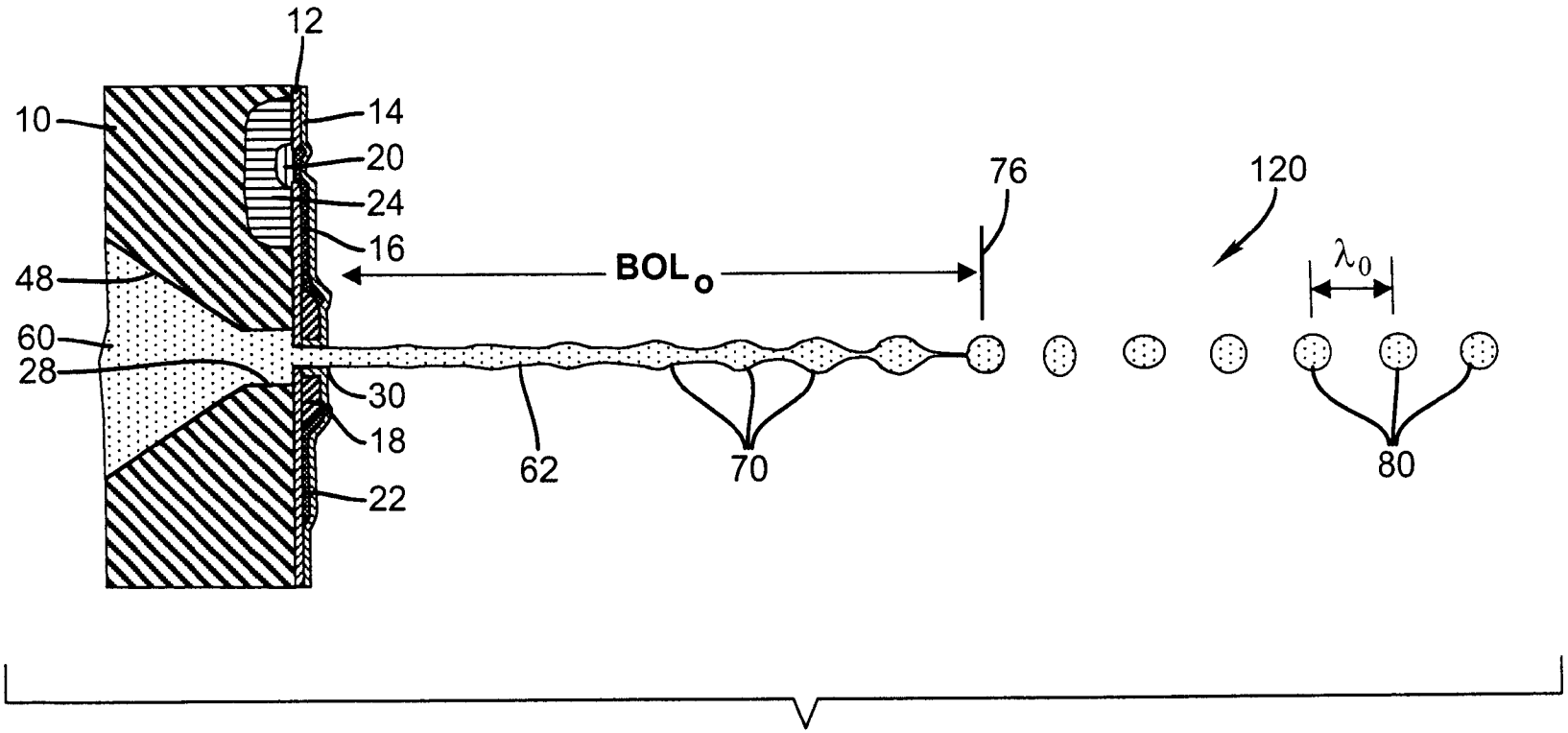

Referring to FIGS. 1(*a*) and 1(*b*), there is shown a portion of a liquid emission apparatus wherein a continuous stream of liquid 62, a liquid jet, is emitted from a nozzle 30 supplied by a liquid 60 held under high pressure in a liquid emitter chamber 48. The liquid stream 62 in FIG. 1(*a*) is illustrated as breaking up into droplets 66 after some distance 77 of travel from the nozzle 30. The liquid stream illustrated will be termed a natural liquid jet or stream of drops of undetermined volumes 100. The travel distance 77 is commonly referred to as the break-off length (BOL). The liquid stream 62 in FIG. 1(*a*) is breaking up naturally into drops of varying volumes. As noted above, the physics of natural liquid jet break-up was analyzed in the late nineteenth century by Lord Rayleigh and other scientists. Lord Rayleigh explained that surface waves form on the liquid jet having spatial wavelengths, $\lambda$, that are related to the diameter of the jet, $d_j$, that is nearly equal to the nozzle 30 diameter, $d_n$. These naturally occurring surface waves, $\lambda_n$, have lengths that are distributed over a range of approximately, $\pi d_j \leqq \lambda_n \leqq 10 d_j$.

Natural surface waves 64 having different wavelengths grow in magnitude until the continuous stream is broken up in to droplets 66 having varying volumes that are indeterminate within a range that corresponds to the above remarked wavelength range. That is, the naturally occurring drops 66 have volumes $V_n \approx \lambda_n(\pi d_j^2/4)$, or a volume range: $(\pi^2 d_j^3/4) \leqq V_n \leqq (10\pi d_j^3/4)$. In addition there are extraneous small ligaments of fluid that form small drops termed "satellite" drops among main drop leading to yet more dispersion in the drop volumes produced by natural fluid streams or jets. FIG. 1(*a*) illustrates natural stream break-up at one instant in time. In practice the break-up is chaotic as different surfaces waves form and grow at different instants. A break-off length for the natural liquid jet 100, $BOL_n$, is indicated; however, this length is also highly time-dependent and indeterminate within a wide range of lengths.

FIG. 1(*b*) illustrates a liquid stream 62 that is being controlled to break up into drops of predetermined volumes 80 at predetermined intervals, $\lambda_0$. The break-up control or synchronization of liquid stream 62 is achieved by a resistive heater apparatus adapted to apply thermal energy pulses to the flow of pressurized liquid 60 immediately prior to the nozzle 30. One embodiment of a suitable resistive heater apparatus according to the present inventions is illustrated by heater resistor 18 that surrounds the fluid 60 flow. Resistive heater apparatus according to the present inventions will be discussed in more detail herein below. The synchronized liquid stream 62 is caused to break up into a stream of drops of predetermined volume, $V_0 \approx \lambda_0(\pi d_j^2/4)$ by the application of thermal pulses that cause the launching of a dominant surface wave 70 on the jet. To launch a synchronizing surface wave of wavelength $\lambda_0$ the thermal pulses are introduced at a frequency $f_0 = v_{j0}/\lambda_0$, where $v_{j0}$ is the desired operating value of the liquid stream velocity.

FIG. 1(*b*) also illustrates a stream of drops of predetermined volumes 120 that is breaking off at 76, a predetermined, preferred operating break-off length distance, $BOL_0$. While the stream break-up period is determined by the stimulation wavelength, the break-off length is determined by the intensity of the stimulation. The dominant surface wave initiated by the stimulation thermal pulses grows exponentially until it exceeds the stream diameter. If it is initiated at higher amplitude the exponential growth to break-off can occur within only a few wavelengths of the stimulation wavelength. Typically a weakly synchronized jet, one for which the stimulation is just barely able to become dominate before break-off occurs, break-off lengths of ~12 $\lambda_0$ will be observed. The preferred operating break-off length illustrated in FIG. 1(*b*) is 8 $\lambda_0$. Shorter break-off lengths may be chosen and even BOL~1 $\lambda_0$ is feasible.

Achieving very short break-off lengths may require very high stimulation energies, especially when jetting viscous liquids. The stimulation structures, for example, heater resistor 18, may exhibit more rapid failure rates if thermally cycled to very high temperatures, thereby imposing a practical reliability consideration on the break-off length choice. For prior art CIJ acoustic stimulation, it is exceedingly difficult to achieve highly uniform acoustic pressure over distances greater than a few centimeters.

The known factors that are influential in determining the break-off length of a liquid jet include the jet velocity, nozzle shape, liquid surface tension, viscosity and density, and stimulation magnitude and harmonic content. Other factors such as surface chemical and mechanical features of the final fluid passageway and nozzle exit may also be influential. When trying to construct a liquid drop emitter comprised of a large array of continuous fluid streams of drops of predetermined volumes, these many factors affecting the break-off length lead to a serious problem of non-uniform break-off length among the fluid streams. Non-uniform break-off length, in turn, contributes to an indefiniteness in the timing of when a drop becomes ballistic, i.e. no longer propelled by the reservoir and in the timing of when a given drop may be selected for deposition or not in an image or other layer pattern at a receiver.

Figure 2:
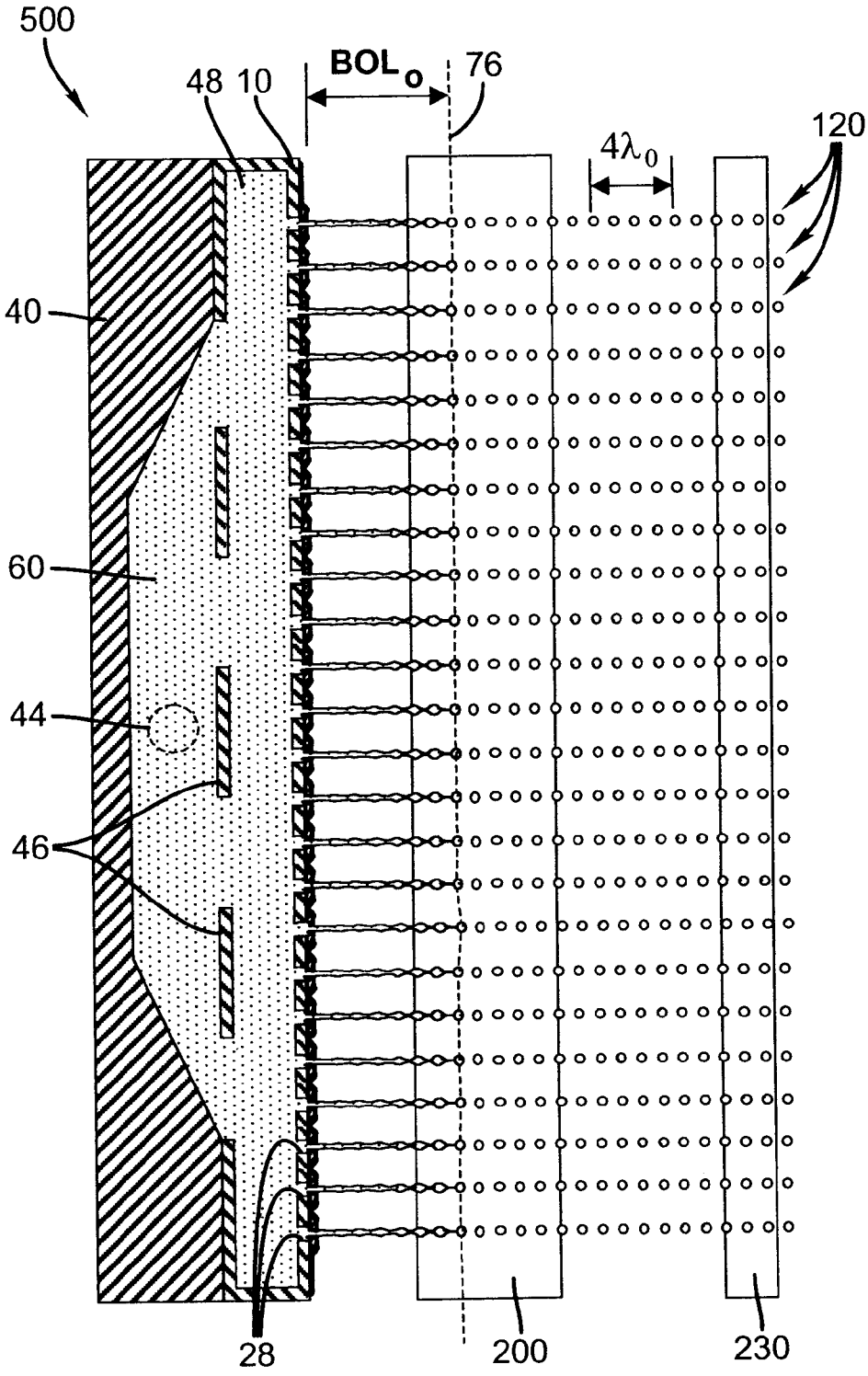
FIG. 2 is a top side view illustration of a liquid drop emitter system having a plurality of liquid streams breaking up into drops of predetermined volumes wherein the break-off lengths are controlled to an operating length.

FIG. 2 illustrates a top view of a multi-jet liquid drop emitter 500 employing thermal stimulation to synchronize all of the streams to break up into streams of drops of predetermined volumes 120. However, the break-off lengths of the plurality of jets are controlled to approximately an equal length, $BOL_o$ 76, by a break-off control apparatus as is disclosed in co-pending U.S. patent application Ser. No. 11/229,467 filed concurrently herewith, entitled "INK JET BREAK-OFF LENGTH CONTROLLED DYNAMICALLY BY INDIVIDUAL JET STIMULATION," in the name of Gilbert A. Hawkins, et al.

Liquid drop emitter 500 is illustrated in partial sectional view as being constructed of a substrate 10 that is formed with thermal stimulation elements surrounding nozzle structures as illustrated in FIGS. 1(*a*) and 1(*b*). Substrate 10 is also configured to have flow separation regions 28 that separate the liquid 60 flow from the pressurized liquid supply chamber 48 into streams of pressurized liquid to individual nozzles. Pressurized liquid supply chamber 48 is formed by the combination of substrate 10 and pressurized liquid supply manifold 40 and receives a supply of pressurized liquid via inlet 44 shown in phantom line. In many preferred embodiments of the present inventions substrate 10 is a single crystal semiconductor material having MOS circuitry formed therein to support various transducer elements of the liquid drop emission system. Strength members 46 are formed in the substrate 10 material to assist the structure in withstanding hydrostatic liquid supply pressures that may reach 100 psi or more.

Figure 3:
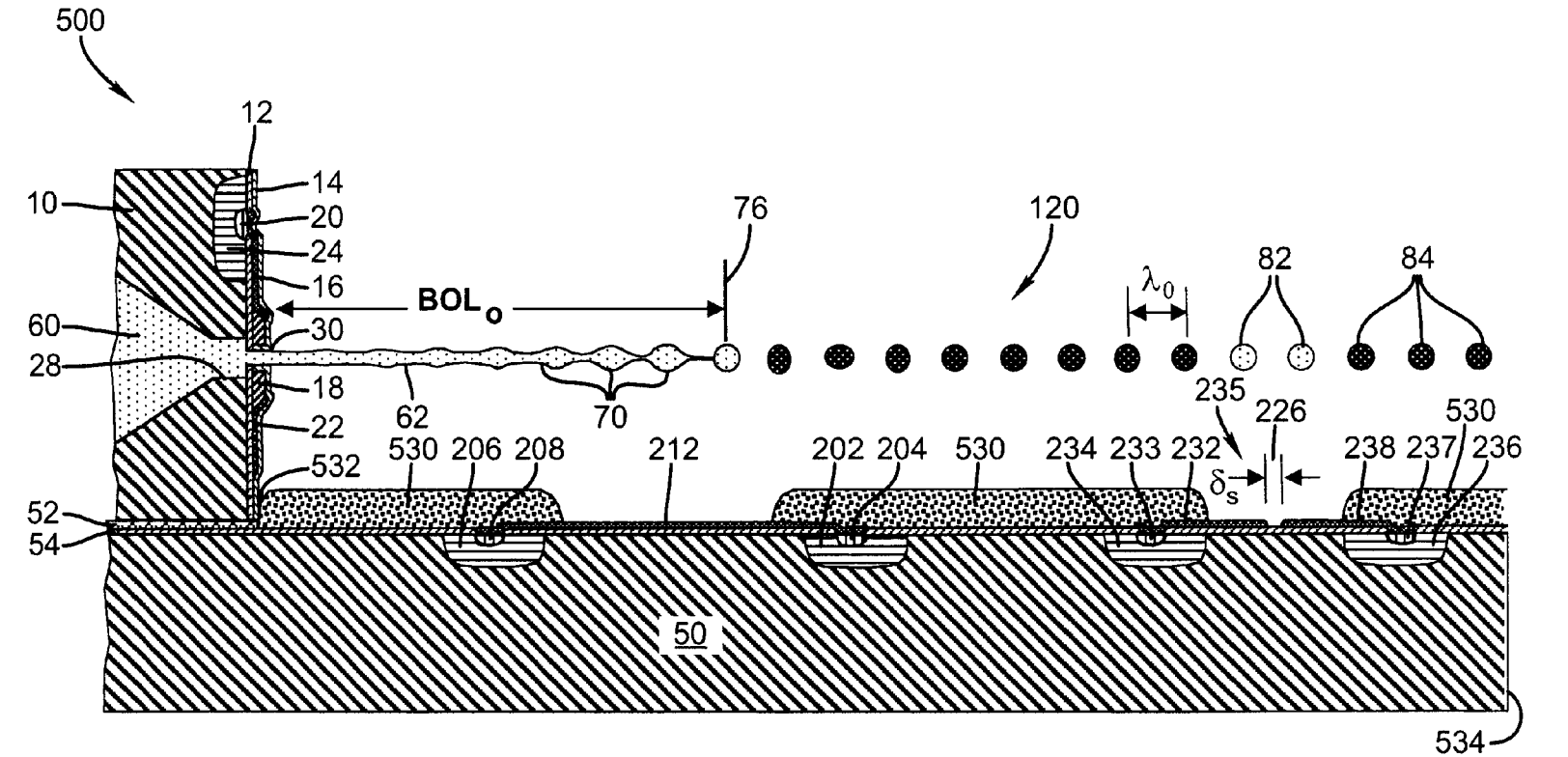
FIG. 3 is a side view illustration of a continuous liquid stream undergoing thermally stimulated break up into drops of predetermined volumes further illustrating integrated drop charging and sensing apparatus according to the present inventions.

FIG. 3 illustrates in side view a preferred embodiment of the present inventions that is constructed of a multi jet drop emitter 500 assembled to a common semiconductor substrate 50 that is provided with integrated inductive charging and electrostatic drop sensing apparatus according to the present inventions. Only a portion of the drop emitter 500 structure is illustrated and FIG. 3 may be understood to also depict a single jet drop emitter according to the present inventions as well as one jet of a plurality of jets in multi-jet drop emitter 500. Substrate 10 is comprised of a single crystal semiconductor material, typically silicon, and has integrally formed heater resistor elements 18 and MOS power drive circuitry 24. MOS circuitry 24 includes at least a power driver circuit or transistor and is attached to resistor 18 via a buried contact region 20 and interconnection conductor run 16. A common current return conductor 22 is depicted that serves to return current from a plurality of heater resistors 18 that stimulate a plurality of jets in a multi-jet array. Alternately a current return conductor lead could be provided for each heater resistor. Layers 12 and 14 are electrical and chemical passivation layers.

Electrodes 232 and 238 of a drop sensing site 235 are positioned adjacent to the plurality of drop streams 120. Drop sensing site 235 is one of a plurality of sensor sites associated with each of the plurality of drop streams. That is, the drop sensing apparatus depicted in FIG. 3 is a sensor-per-jet type configuration. Electrostatic charged drop detectors are known in the prior art; for example, see U.S. Pat. No. 3,886,564 to Naylor, et al. and U.S. Pat. No. 6,435,645 to M. Falinski. As depicted in FIG. 3, drops of predetermined volume, $V_0$, are being generated at wavelength $\lambda_0$ from all drop streams 120. In the illustration of FIG. 3 most of the drops being generated are being inductively charged and subsequently deflected by a deflection apparatus not shown that is illustrated in figures below, i.e. FIGS. 4 and 5. Pairs of drops 82 are not charged and not deflected and are illustrated flying towards the receiver location 300 in FIG. 5. Electrodes 232 and 238 of electrostatic drop sensing site 235 have a small gap, less than $\lambda_0$ in order to be able to discriminate the passage of individual charged drops.

The drop emitter functional elements illustrated herein may be constructed using well known microelectronic fabrication methods. Fabrication techniques especially relevant to the CIJ stimulation heater and CMOS circuitry combination utilized in the present inventions are described in U.S. Pat. Nos. 6,450,619; 6,474,794; and 6,491,385 to Anagnostopoulos, et al., assigned to the assignees of the present inventions. Further applicable NMOS circuitry fabrication and design techniques that are readily applicable are disclosed in U.S. Pat. No. 4,947,192 to Hawkins, et al. High voltage MOS circuitry fabrication and design techniques useful for switching deflection electrode voltages are disclosed in U.S. Pat. No. 4,288,801 to R. Ronen.

Substrate 50 is comprised of either a single crystal semiconductor material, especially silicon or gallium arsenide, or a microelectronics grade material capable of supporting epitaxy or thin film semiconductor MOS circuit fabrication. An inductive drop charging apparatus is integrated in substrate 50 comprising per jet charging electrode 212, buried MOS circuitry 206, 202 and contacts 208, 204. The integrated MOS circuitry includes at least amplification circuitry with slew rate capability suitable for inductive drop charging within the period of individual drop formation, $\tau_0$. While not illustrated in the side view of FIG. 3, the inductive charging apparatus is configured to have an individual electrode and MOS circuit capability for each jet of multi-jet liquid drop emitter 500 so that the charging of individual drops within individual streams may be accomplished.

Integrated drop sensing apparatus comprises a dual electrode structure per sensor site 235 depicted as dual electrodes 232 and 238 having a gap $\delta_s$ therebetween along the direction of drop flight. The dual electrode gap $\delta_s$ is designed to be less that a drop wavelength $\lambda_0$ to assure that drop arrival times may be discriminated with accuracies better than a drop period, $\tau_0$. Integrated sensing apparatus MOS circuitry 234, 236 is connected to the dual electrodes via connection contacts 233, 237. The integrated MOS circuitry comprises at least differential amplification circuitry capable of detecting above the noise the small voltage changes induced in electrodes 232, 238 by the passage of charged drops 80. In FIG. 3 a pair of uncharged drops 82 is detected by the absence of a two-drop voltage signal pattern within the stream of charged drops.

Layer 54 is a chemical and electrical passivation layer. Substrate 50 is assembled perpendicularly and bonded to drop emitter 500 via adhesive layer 52 as shown in FIG. 3, so that the drop charging and sensing apparatus are properly aligned with the plurality of drop streams. A passivation and location feature layer 530 is formed as an upper layer on substrate 50. Suitable materials for this layer are durable and patternable organic films commonly used in thermal ink jet printhead fabrication such as polyimides and epoxies and other hard curing adhesives. Edge 532 in layer 530 is used as a location feature to position drop generator 500 on substrate 50 in the direction of the drop emission, therefore locating the nozzle 30 properly with respect to charging electrode 212.

Figure 4:
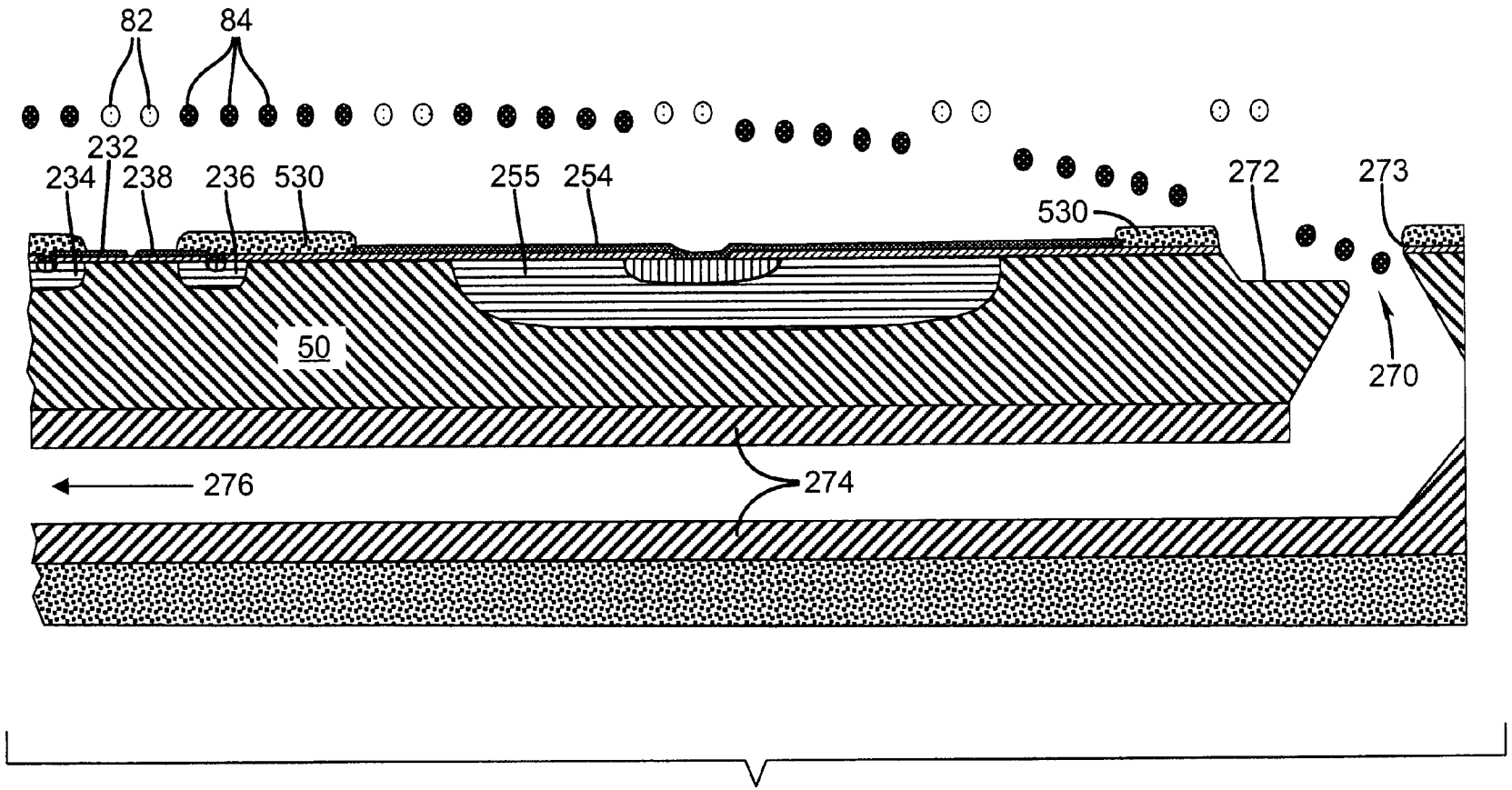
FIG. 4 is a side view illustration of a stream of drops of predetermined volumes undergoing the drop actions of sensing, deflecting and capturing via apparatus formed on a common semiconductor substrate according to the present inventions.

A continuous liquid drop emission system has apparatus that perform actions on the stream of synchronized drops that may include some combination of drop charging, sensing, deflecting and capturing. FIG. 4 illustrates in side view a semiconductor substrate 50 having three integrated drop actions: electrostatic drop sensing, vertical deflection of previously charged drops and capture of the deflected drops, in that order as the drop stream travels from left to right in the figure. The drop sensing apparatus is the same as depicted following drop charging illustrated and discussed above with respect to FIG. 3.

Drop deflection electrode 254 is attached to underlying high voltage MOS driver circuitry 255. The deflection electrode is switched to a high voltage having a polarity that attracts the charge sign (positive or negative) that is induced on drops by a charging apparatus. In order to cause significant deflection of a charged drop, the deflection electrode must extend a substantial distance along the flight path of the drops, i. e., several millimeters. Therefore an integrated drop deflection apparatus requires relatively large and costly areas on the semiconductor substrate 50. On the other hand, because the deflection zone along the drop flight path is necessarily long, there is enough semiconductor "real estate" beneath a deflection electrode 254 that HV MOS devices may be fabricated.

FIG. 4 depicts a deflection electrode per jet configuration for the deflection apparatus. The deflection field may be individually adjusted for each drop stream by adjusting the voltage amplitude or dwell time, or both, for each stream of drops. This capability may also be used to individually adjust drop flight trajectories to compensate for various phenomena that cause errors in the undeflected flight paths of a plurality of jets; for example, nozzle differences and velocity differences. In addition, because the individual deflection fields are closely spaced, a certain level of field fringing between neighboring jets will occur and may also be adjusted to provide some small amount of drop deflection in the transverse direction.

The drop capturing apparatus depicted in FIG. 4 is representative of a design based on orientation dependent etching of single crystal semiconductor materials, especially silicon. That is, through substrate passage 270, capture lip 273 and a grooved landing surface are created by ODE processing on both sides of semiconductor substrate 50.

Figure 5:
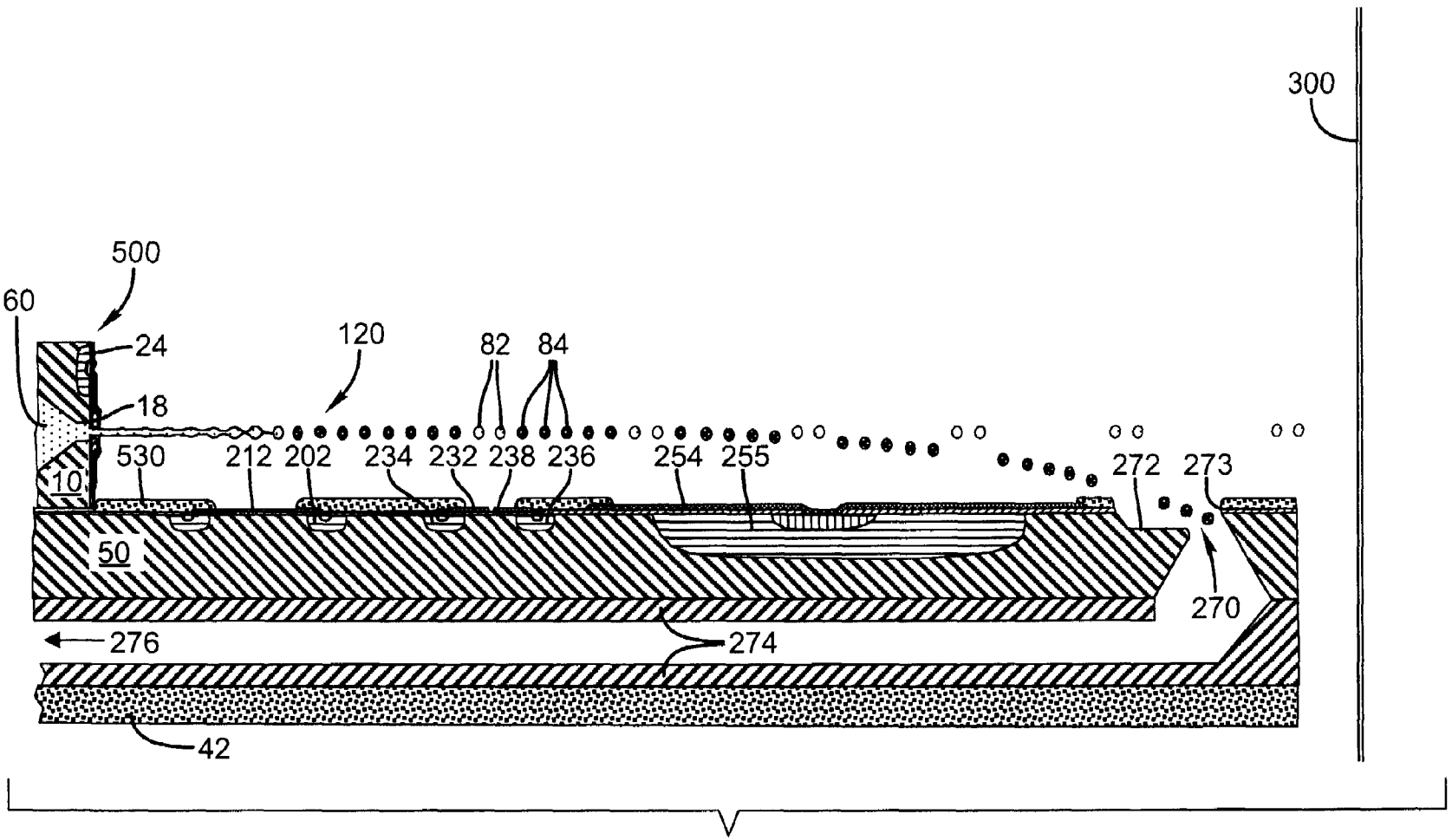
FIG. 5 is a side view illustration of a stream of drops of predetermined volumes undergoing the drop actions of charging, sensing, deflecting, and capturing via apparatus formed on a common semiconductor substrate according to the present inventions.

FIG. 5 illustrates in side view a liquid drop emission system that combines all of the functions illustrated in FIGS. 3 and 4 into a single semiconductor substrate 50. A thermally stimulated drop generator 500 is affixed to semiconductor substrate 50 assisted by the location features illustrated in FIG. 3. Semiconductor substrate 50 includes apparatus for four drop actions: charging, sensing, deflecting and capturing. Charged drops 84 are deflected for capture in gutter apparatus 270, 272, 273. Uncharged drops 82 are illustrated flying along an initial trajectory to the receiver surface 300. Semiconductor substrate 50 is mounted on guttered liquid return manifold 274 which is, in turn, mounted on drop emission system support plate 42. A vacuum source 276 is attached (not shown) to the guttered liquid return manifold. Unprinted drops 84 are captured in the gutter apparatus and evacuated for recirculation back through the drop generator 500.

The various drop action apparatus of the liquid drop emission system are not intended to be shown to relative distance scale in FIG. 5. In practice a Coulomb deflection apparatus such as the E-field type illustrated, would be much longer relative to typical stream break-off lengths and charging apparatus electrode lengths in order to develop enough off axis movement to descend below the lip 273 of the drop capturing apparatus.

Figure 6:
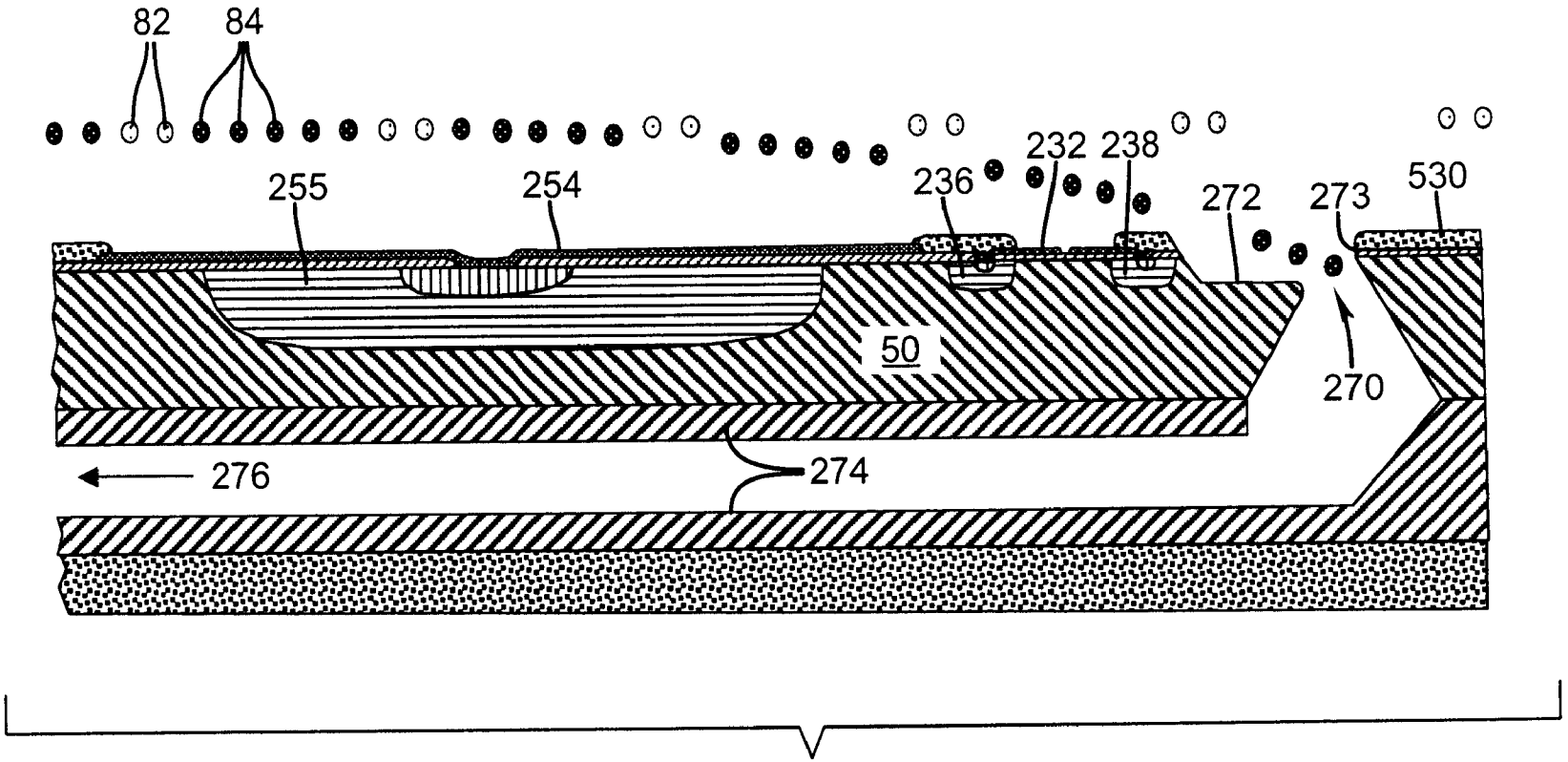
FIG. 6 is a side view illustration of a stream of drops of predetermined volumes undergoing the drop actions of deflecting, sensing and capturing via apparatus formed on a common semiconductor substrate according to the present inventions.
Figure 7:
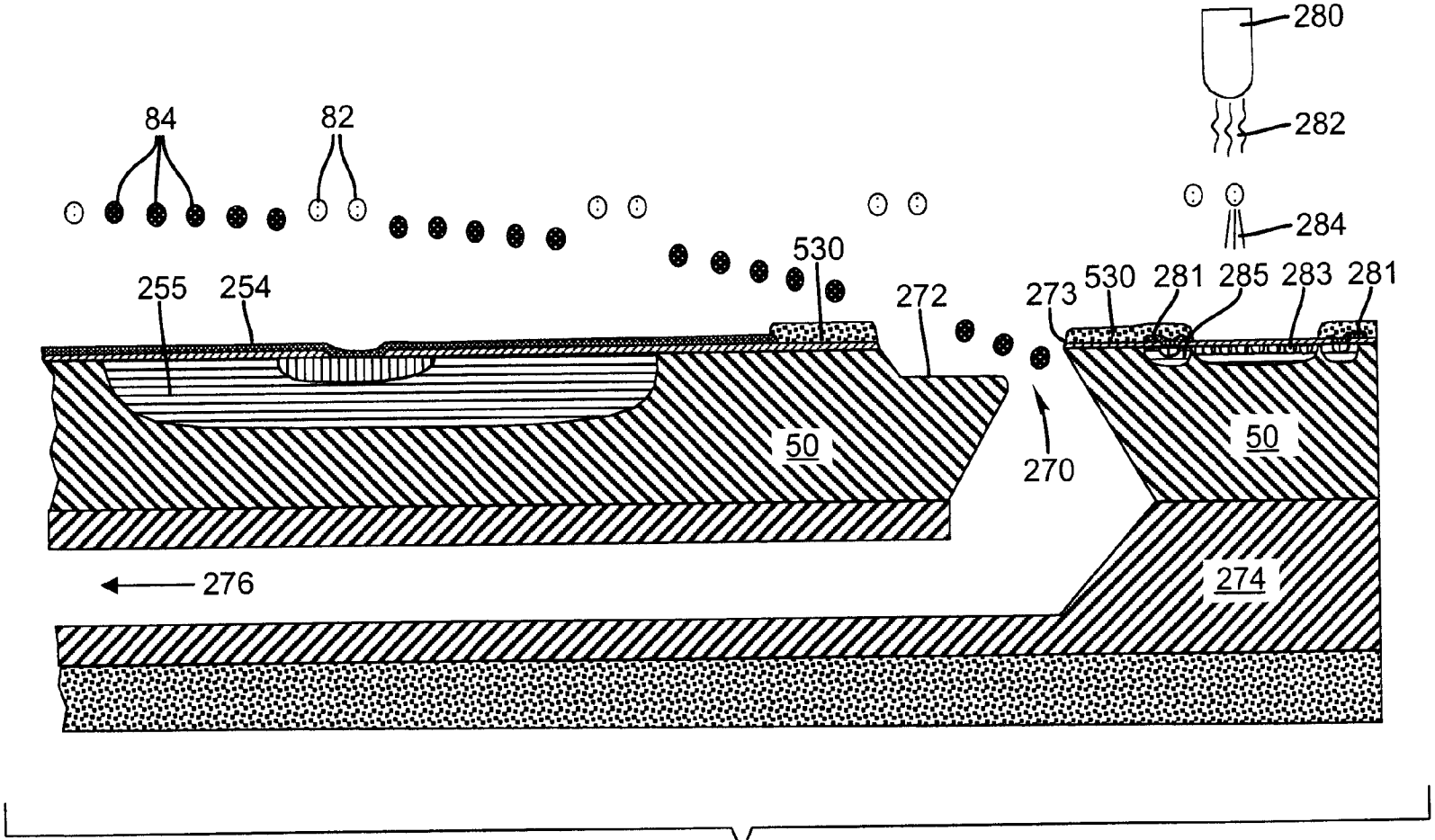
FIG. 7 is a side view illustration of a stream of drops of predetermined volumes undergoing the drop actions of deflecting, capturing, and sensing via apparatus formed on a common semiconductor substrate according to the present inventions.

FIGS. 6 and 7 depict alternate arrangements of integrated drop action apparatus. FIG. 6 depicts the positioning of an electrostatic drop sensor site 235 (illustrated in FIG. 3) and underlying MOS circuitry 236, 238 after the deflection apparatus and just prior to a drop capture or guttering apparatus 270, 272, 273. Positioning the drop sensor function a farther distance from the nozzle allows sensor measurements of drop arrival times to more easily detect anomalous drop charging and other deviations from desired operating parameters.

FIG. 7 depicts a configuration wherein drop sensing apparatus is located after drop deflection and capture apparatus. The drop sensor illustrated is a multi-element optical detector 283, such as a CCD array or light sensitive MOSFET. The drop sensor in this position detects uncharged or lowly charged drops that have not been deflected to the gutter. An illumination source 280 located above the drop streams illuminates 282 the uncharged drops 82, casting shadows 284 onto the optical detector array 283. Underlying MOS circuitry 285 decodes the detected shadow pattern signals into a usable data stream. Sensor output leads 281 are routed to either off-substrate drop emission system control electronics or, potentially, other control circuitry also integrated within substrate 50. Sensing un-captured drops is advantageous since these are the drops actually used to form images and patterns. The more precisely the positions of print drops can be monitored, the more directly effective can be drop emission system automatic feedback control methods.

Figure 8:
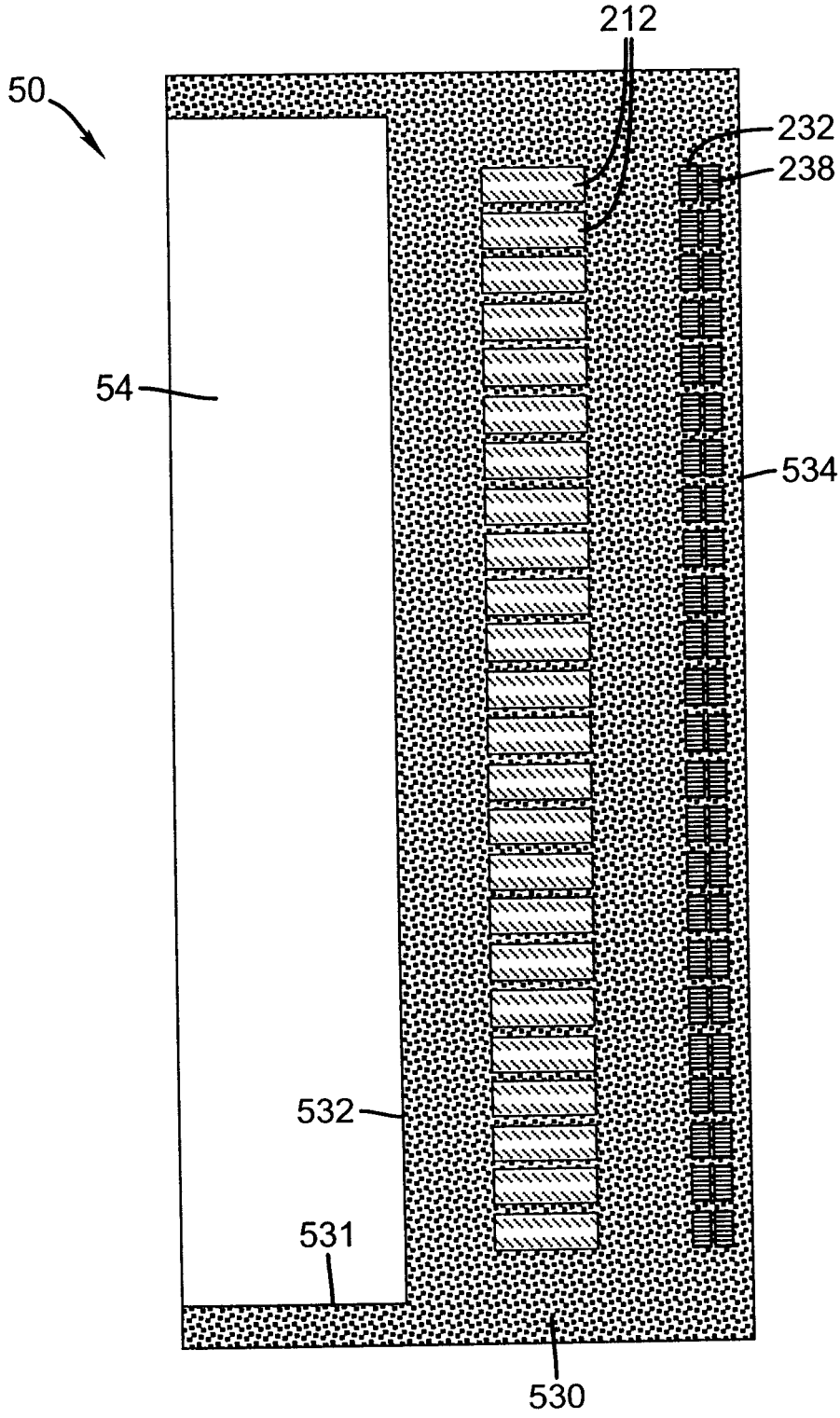
FIG. 8 is a top side plan view illustration of common semiconductor substrate on which is formed charging apparatus and sensing apparatus having individual transducers for a plurality of jets and location features to assist in the precision assembly of a drop generator to the semiconductor substrate according to the present inventions.

FIG. 8 illustrates in plan view a semiconductor substrate 50 as depicted in FIG. 3 according to the present inventions, before the mounting of a drop generator. The drop action transducer sites are depicted as visible through openings in passivation and location feature layer 530. A plurality of drop charging electrodes 212 and dual electrode 232, 238 charged drop sensor sites are depicted. In addition, a location area for a drop generator is formed by edges 531 and 532 in layer 530. Finally, edge 534 of semiconductor substrate 50 is precisely located with respect to the drop action transducers and drop generator location edges. Precisely formed edge 534 may be used to locate semiconductor substrate 50 with respect to overall drop emission mounting support hardware or additional drop action apparatus such as deflection and capture apparatus.

Figure 9:
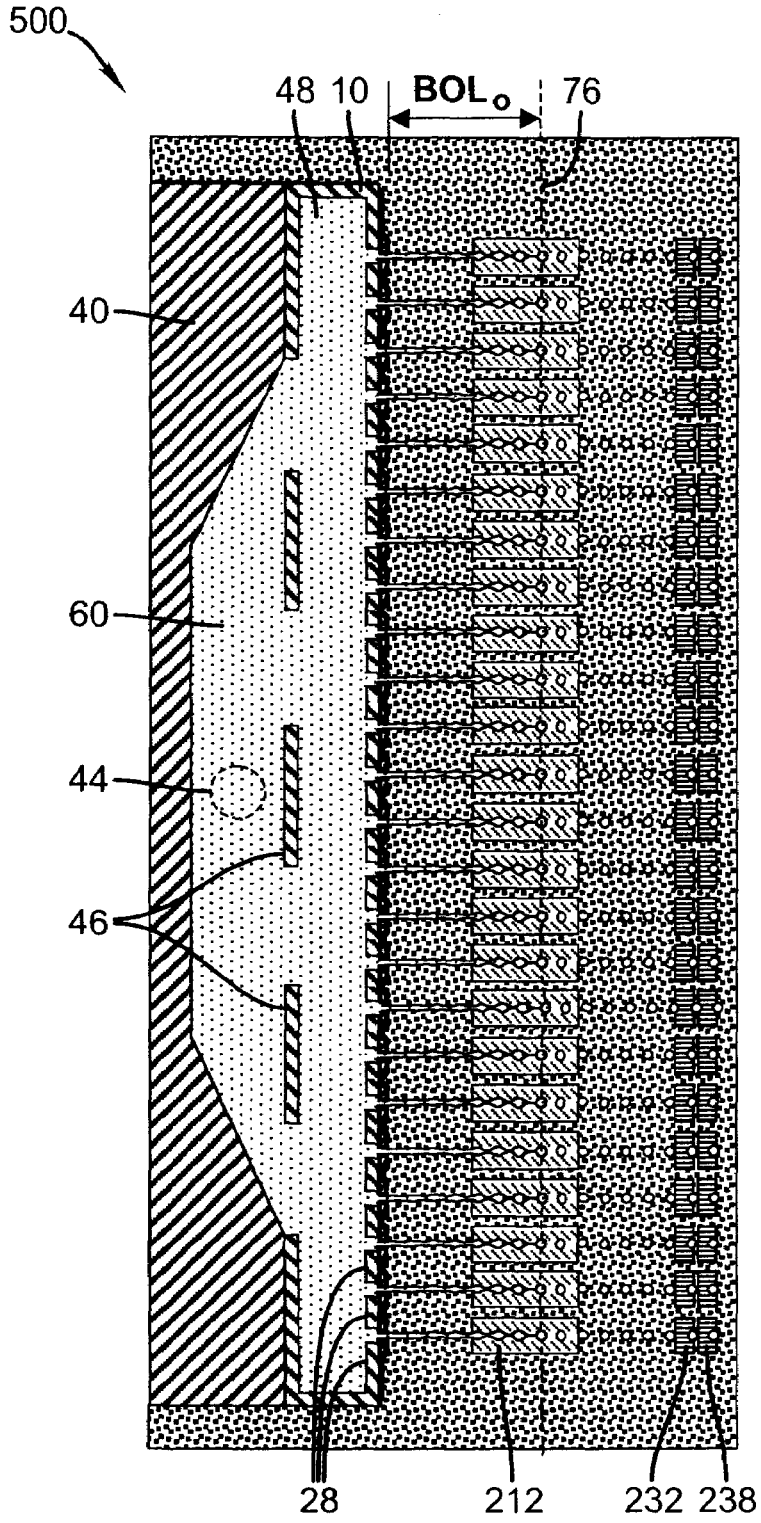
FIG. 9 is a top side plan view illustration of a drop emitter assembled to the common semiconductor substrate illustrated in FIG. 8 according to the present inventions.

FIG. 9 illustrates in plan view the mounting of a thermally stimulated drop generator 500 to a semiconductor substrate 50 having the drop action functions depicted in FIG. 8. Drop generator 500 has the properties of the drop generator illustrated and discussed previously with respect to FIG. 2. This plan view illustration depicts the same liquid drop emission system that is illustrated in side view in FIG. 3.

Figure 10:
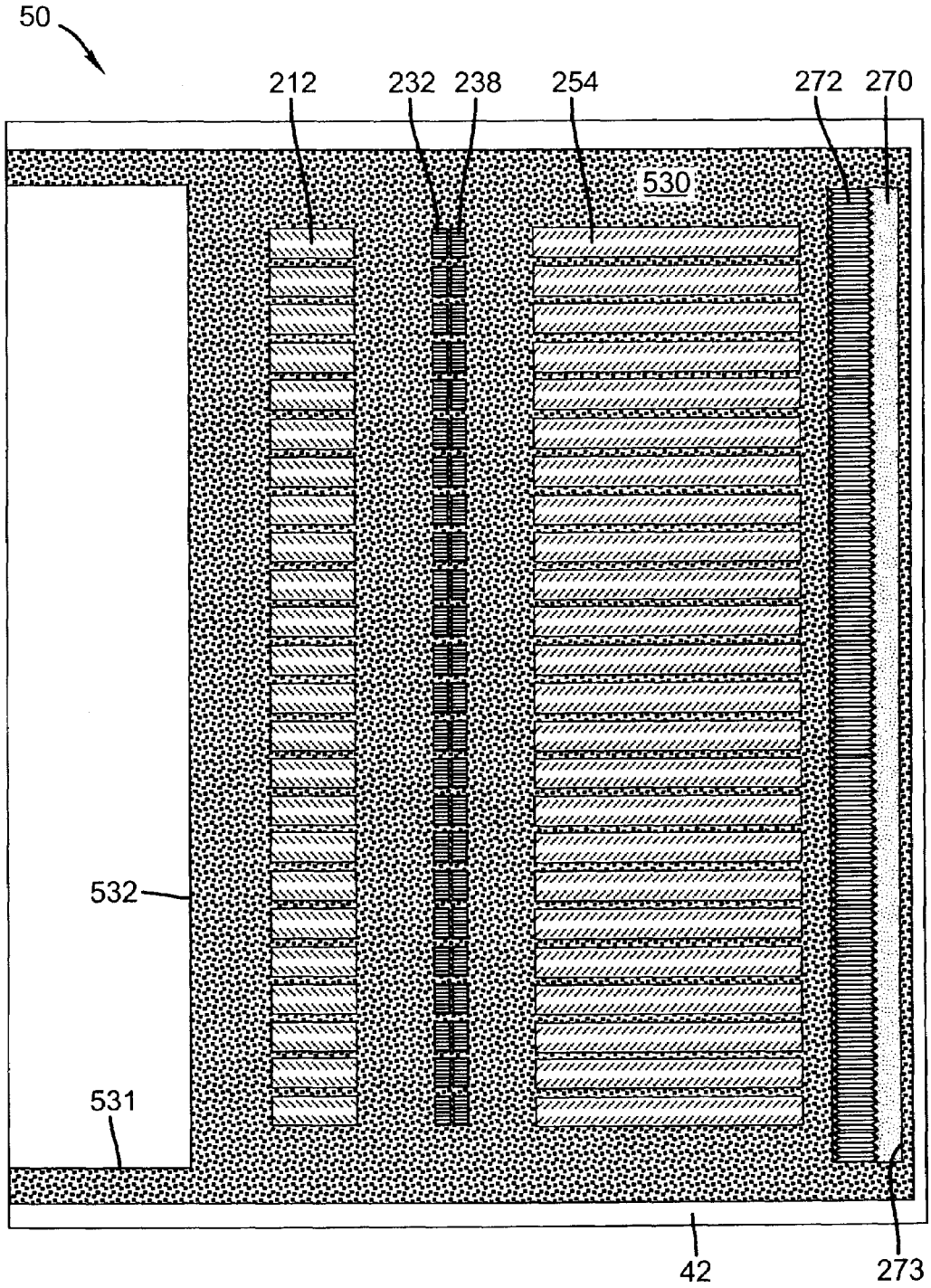
FIG. 10 is a top side plan view illustration of common semiconductor substrate on which is formed charging apparatus, sensing apparatus, deflecting apparatus all having individual transducers for a plurality of jets; array-wide drop capturing apparatus; and location features to assist in the precision assembly of a drop generator to the semiconductor substrate according to the present inventions.

FIG. 10 illustrates in plan view a semiconductor substrate 50 as depicted in FIG. 5 according to the present inventions, before the mounting of a drop generator. The drop action transducer sites are depicted as visible through openings in passivation and location feature layer 530. A plurality of drop charging electrodes 212; dual electrode 232, 238 charged drop sensor sites; and drop deflection electrodes 254 are depicted. An array-wide drop capture apparatus consisting of ODE etched grooved landing surface 272 and capture opening 270 are also included in semiconductor substrate 50 of FIG. 10. In addition, a location area for a drop generator is formed by edges 531 and 532 in layer 530.

Figure 11:
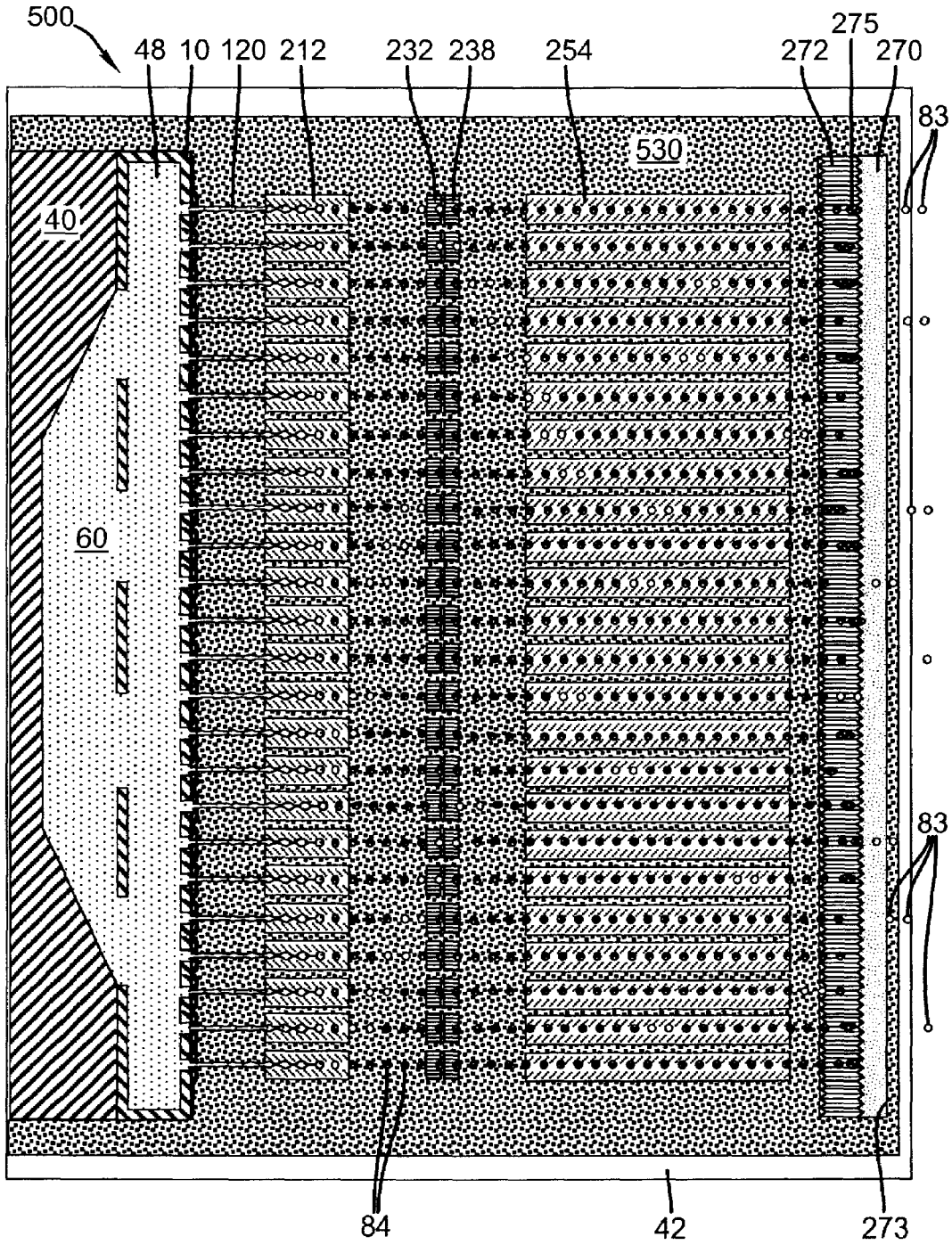
FIG. 11 is a top side plan view illustration of a drop emitter assembled to the common semiconductor substrate illustrated in FIG. 10 according to the present inventions.

FIG. 11 illustrates in plan view the mounting of a thermally stimulated drop generator 500 to a semiconductor substrate 50 having the drop action functions depicted in FIG. 10. Drop generator 500 has the properties of the drop generator illustrated and discussed previously with respect to FIG. 2. This plan view illustration depicts the same liquid drop emission system that is illustrated in side view in FIG. 5. Charged drops 84 are deflected and captured by the drop capture apparatus. Uncharged drops 83 fly on an initial trajectory past the capture opening 270 and capture lip 273 and travel toward a receiver substrate, not shown.

Figure 12:
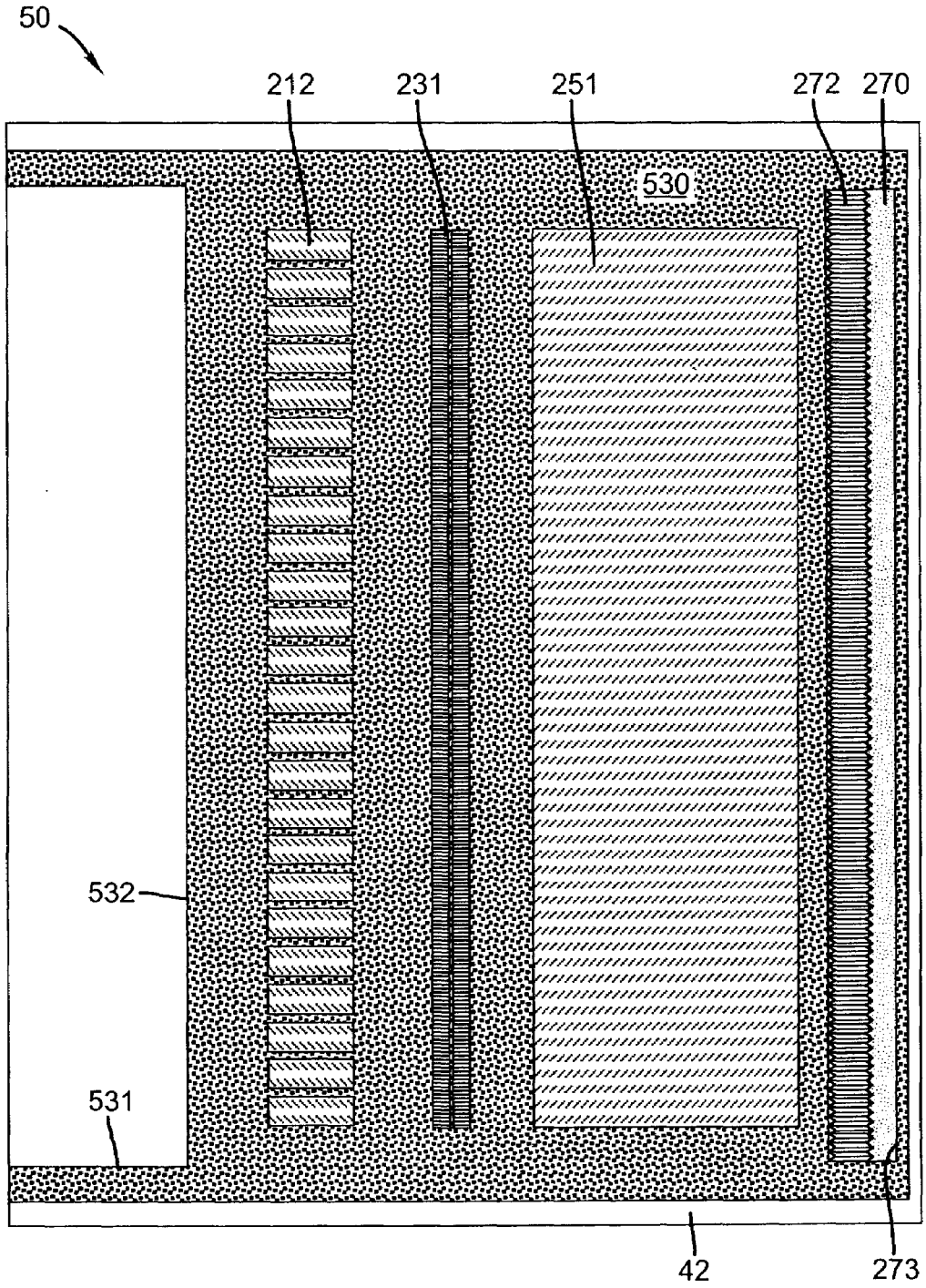
FIG. 12 is a top side plan view illustration of common semiconductor substrate on which is formed charging apparatus for a plurality of jets; array-wide sensing apparatus, deflecting apparatus and capturing apparatus; and location features to assist in the precision assembly of a drop generator to the semiconductor substrate according to the present inventions.

FIG. 12 illustrates in plan view a semiconductor substrate 50 according to the present inventions, before the mounting of a drop generator. The drop action transducer sites are depicted as visible through openings in passivation and location feature layer 530. All of the same drop action types are included in the configuration of FIG. 12 as are included in FIG. 10. However, while the drop charging apparatus has per-jet charge electrodes 212, the drop sensing apparatus sites 231, and drop deflection electrode 251 are provided as an array-wide devices. That is, sensor site 231 spans the plurality of jets and is sensitive to the passage of charged drops from any of the plurality of jets. Similarly, drop deflection electrode 251, when operated, will cause the deflection of charged drops from any of the plurality of streams in equal fashion. The use of array-wide sensing and deflecting apparatus greatly reduces the need for control circuitry and interconnection means, thereby lowering the cost of implementing the integration of these drop actions. On the other hand, the flexibility of simultaneously monitoring performance of a plurality of jets and individually adjusting flight trajectories using individual deflection E-fields is not available.

An intermediate approach of having groups of jets served by sensor apparatus that has sensor sites spanning a group of jets or time-sharing portions of the control circuitry is also contemplated as being included within the metes and bounds of the present inventions. Similarly, deflection electrodes may be configured to span a group of jets or the integrated deflection control circuitry may be time-shared among per-jet deflection electrodes in grouping arrangements according to the present inventions.

For the configuration of the semiconductor substrate 50 illustrated in FIG. 12, an array-wide drop capture apparatus consisting of ODE etched grooved landing surface 272 and capture opening 270 are depicted. In addition, a location area for a drop generator is formed by edges 531 and 532 in layer 530.

A different set of configurations of liquid drop emitters according to the present inventions are illustrated in FIGS. 13 through 20. For these configurations, a plurality of stream stimulation transducers corresponding to the plurality of liquid jets are formed on the semiconductor substrate together with at least one integrated drop action apparatus. An edgeshooter-style drop generator provides a favorable geometry for both locating stimulation transducers in close proximity to a plurality of nozzles and arranging drop action apparatus over substantial distances along the direction of initial drop projection, while forming the needed transducers and associated circuitry in a common semiconductor substrate. The term "edge shooter" in this context refers to the general orientation of the plurality of streams as emerging parallel to the semiconductor substrate on which the stimulation apparatus are formed, i.e. the streams emerge from the "edge" of this substrate rather than perpendicular to it as is the case for the drop generators 500 illustrated in FIGS. 1, 2, 3, 5, 9 and 11.

Figure 13:
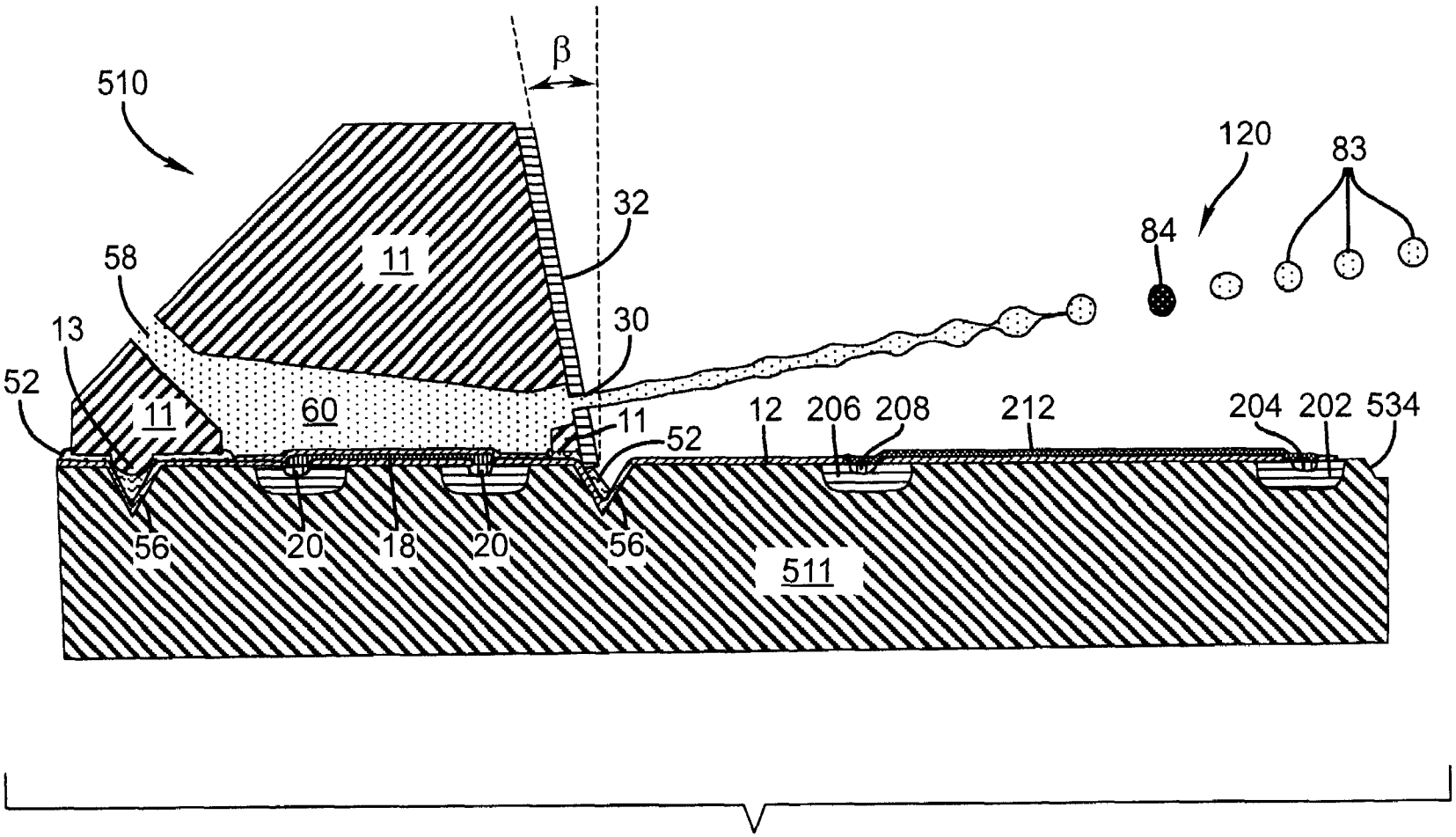
FIG. 13 is a side view illustration of an edgeshooter style liquid drop emitter undergoing thermally stimulated break up into drops of predetermined volumes further illustrating integrated resistive heater and drop charging apparatus according to the present inventions.

FIG. 13 illustrates an edgeshooter liquid drop emitter 510. In contrast to the configuration of the drop emitter 500 illustrated in FIG. 3, drop emitter 510 does not jet the pressurized liquid from an orifice formed in or on semiconductor substrate 511 but rather forward from nozzle 30 in nozzle plate 32 oriented nearly perpendicular to substrate 511. That is, the semiconductor substrate 511 extends forward from the nozzle plate 32 to position the drop action apparatus relative to the stream of drops of predetermined volumes 120, and the stream of drops of predetermined volumes 120 has an initial trajectory that is generally parallel to the surthee or direction of extension of semiconductor substrate 511. Nozzle plate 32 is canted off perpendicular by an angle β as illustrated in FIG. 13. The canting of the nozzle plate by an angular amount β beginning just past the location of stimulation transducers formed in the surface of substrate 511 allows the stream to be projected above any drop action apparatus formed in substrate 511 while at the same time allowing the stimulation transducers to introduce energy pulses to the liquid flow just prior to the nozzles.

For the purposes of the present inventions, the angle β may be understood to characterize the term "generally in the same direction." When β is less than approximately 25°, it is considered herein that semiconductor substrate 511 on which stimulation transducers and at least one drop action apparatus are formed, and the initial trajectory of the pluralities of liquid drop streams, are oriented generally along the same direction.

For liquid drop emitter 510 illustrated in FIG. 13, resistive heater 18 heats pressurized fluid only along one wall of a flow separation passageway 28 (illustrated in FIGS. 1(*a*), 1(*b*), and 3) prior to the jet formation at nozzle 30. While somewhat more distant from the point of jet formation than for the drop emitter 500 of FIG. 3, the arrangement of heater resistor 18 as illustrated in FIG. 13 is still quite effective in providing thermal stimulation sufficient for jet break-up synchronization.

The edgeshooter drop emitter 510 configuration is useful in that the integration of inductive charging apparatus and resistive heater apparatus may be achieved in a single semiconductor substrate 511 as illustrated. The elements of the resistive heater apparatus and inductive charging apparatus in FIG. 13 have been given like identification label numbers as the corresponding elements illustrated and described in connection with above FIG. 3. The description of these elements is the same for the edgeshooter configuration drop emitter 510 as was explained above with respect to the "roofshooter" drop emitter 500.

The direct integration of drop charging and thermal stimulation functions assures that there is excellent alignment of these functions for individual jets. Additional circuitry may be integrated to perform jet stimulation and drop charging addressing for each jet, thereby greatly reducing the need for bulky and expensive electrical interconnections for multi-jet drop emitters having hundreds or thousands jets per emitter head.

Figure 14:
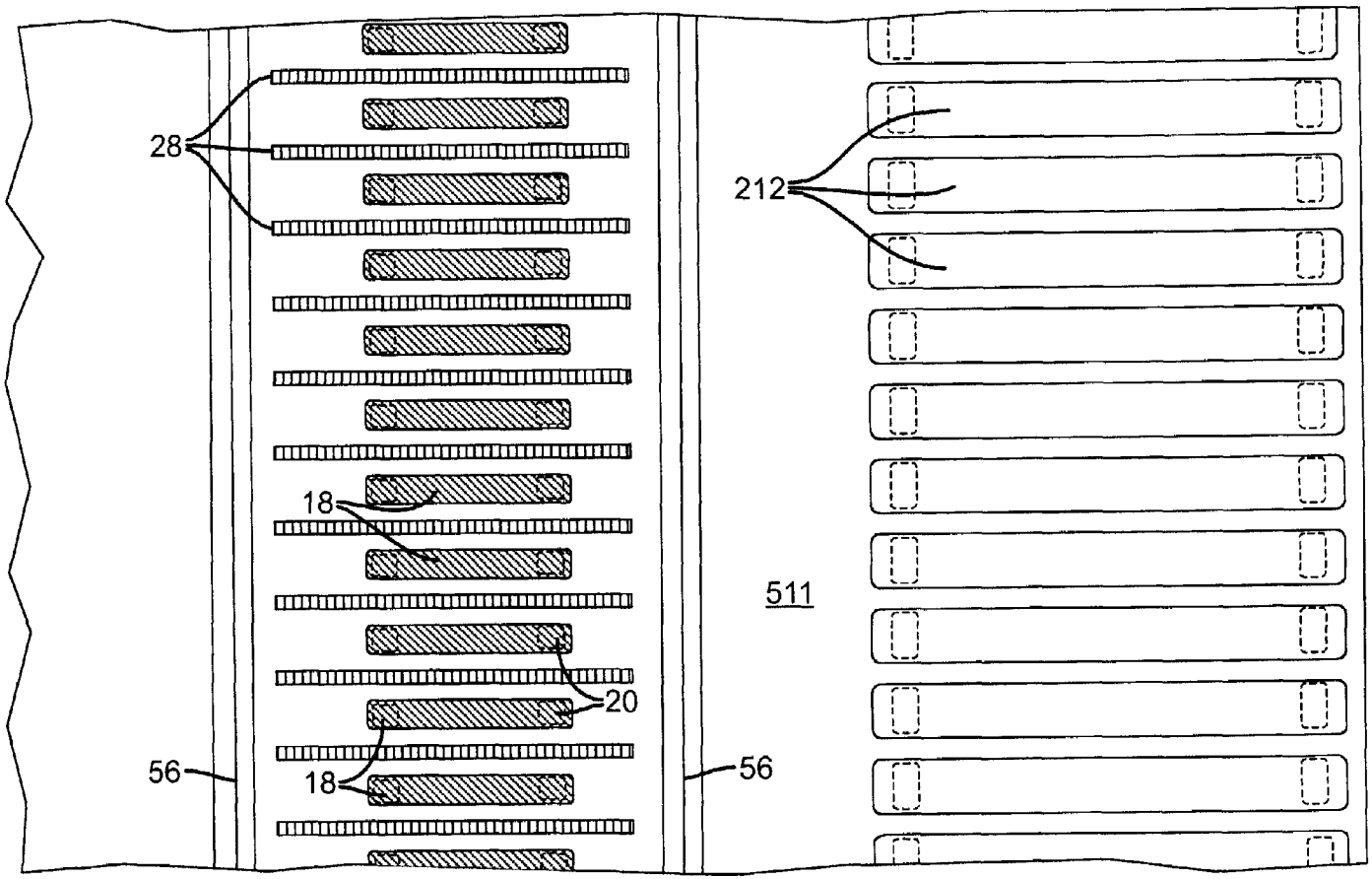
FIG. 14 is a plan view of part of the integrated heater and drop charger per jet array apparatus.

FIG. 14 illustrates in plan view a portion of semiconductor substrate 511 further illuminating the layout of fluid heaters 18, flow separation walls 28 and drop charging electrodes 212. The flow separation walls 28 are illustrated as being formed on substrate 511, for example using a thick photo-patternable material such as polyimide, resist, or epoxy. However, the function of separating flow to a plurality of regions over heater resistors may also be provided as features of the flow separation and chamber member 11, in yet another component layer, or via some combination of these components. Drop charging electrodes 212 are aligned with heaters 18 in a one-for-one relationship achieved by precision microelectronic photolithography methods. The linear extent of drop charging electrodes 212 is typically designed to be sufficient to accommodate some range of jet break-off lengths and still effectively couple a charging electric field to its individual jet.

Figure 15:
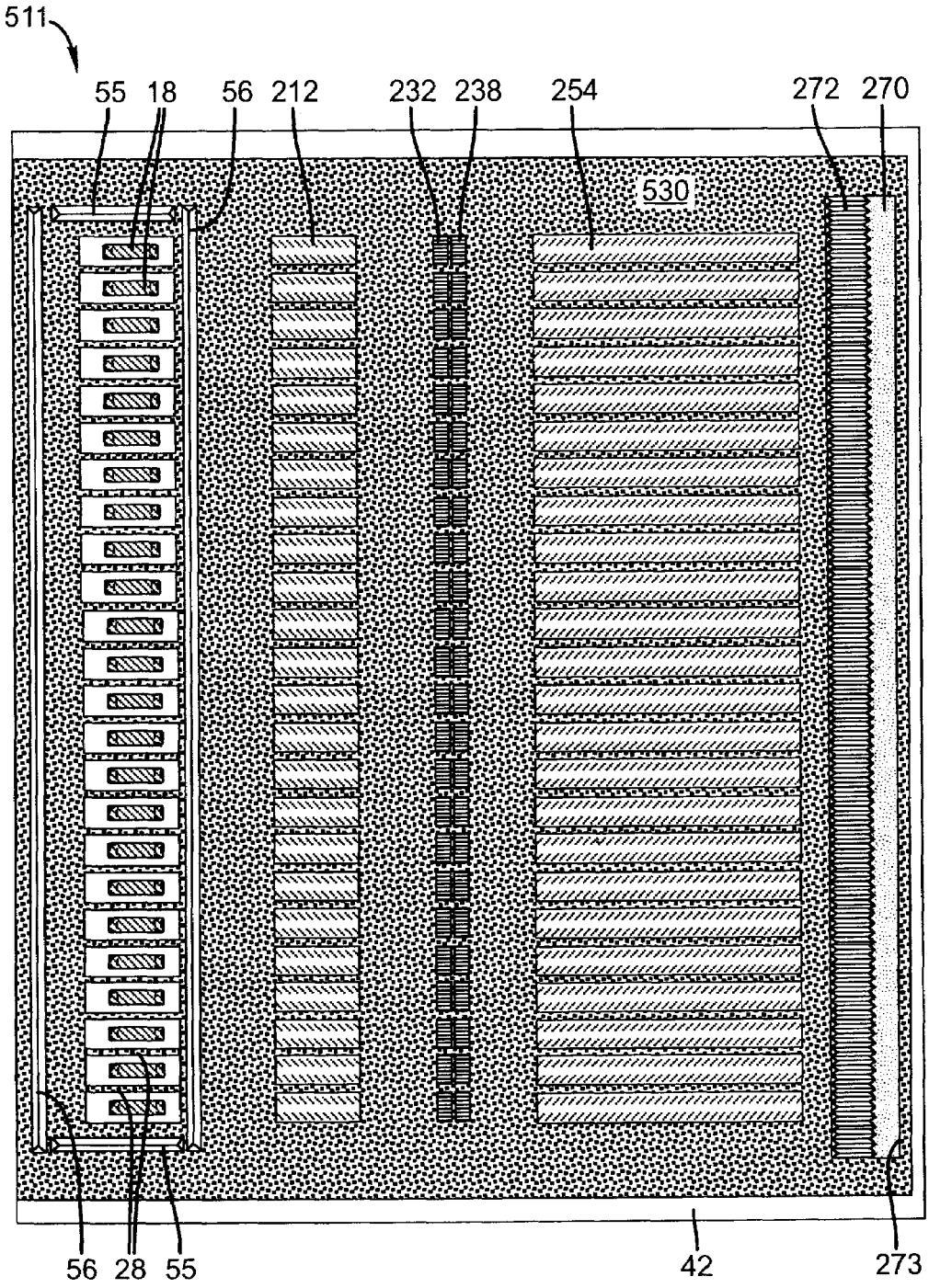
FIG. 15 is a top side plan view illustration of common semiconductor substrate on which is formed thermal stimulation apparatus, charging apparatus, sensing apparatus, deflecting apparatus all having individual transducers for a plurality of jets; array-wide drop capturing apparatus; and location features to assist in the precision assembly of a drop generator to the semiconductor substrate according to the present inventions.

A semiconductor substrate 511 having thermal stream stimulation transducers together with four drop action apparatus for charging, sensing, deflection and capturing is depicted in FIG. 15. Semiconductor substrate 511 is similar to semiconductor substrate 50 illustrated in FIG. 10, with the addition of a plurality of thermal stream stimulation heater transducers 18 and associated control MOS circuitry. Location features 56 and 55 are ODE etched grooves that are used to properly align the flow separation and chamber member 11 with nozzle plate 32 to substrate 511 so that the stimulation transducers 18 align precisely with nozzles 30 and flow separation features 28. For the design depicted in FIG. 15, the flow separation features 28 are walls formed by windowing the passivation and location feature layer 530 over each stream stimulation heater 18.

Figure 16:
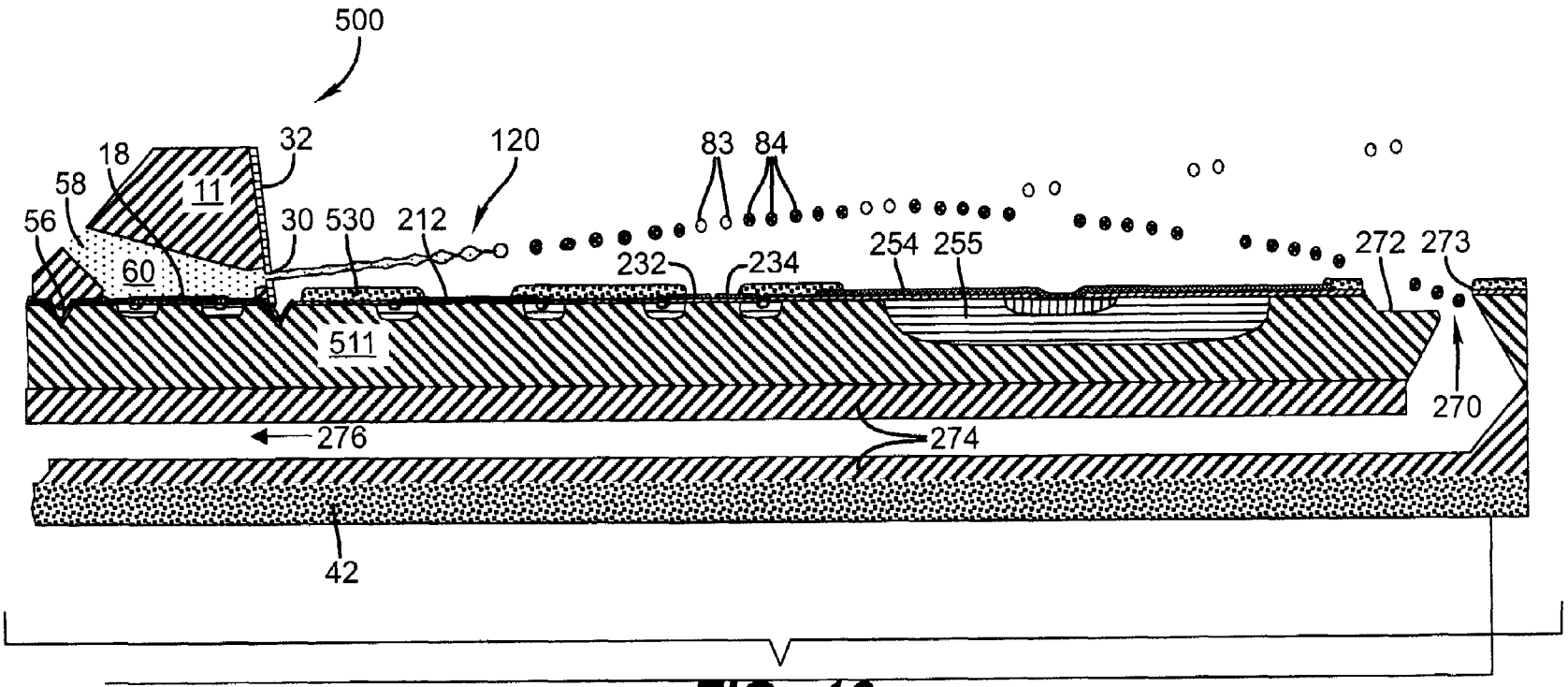
FIG. 16 is a side view illustration of a liquid drop emission apparatus having an integrated semiconductor substrate that includes both thermal stream stimulation apparatus and drop action apparatus formed on a common semiconductor substrate as illustrated in FIG. 15 according to the present inventions.

FIG. 16 illustrates in side view an assembled liquid drop emitter that uses a common semiconductor substrate 511 as illustrated in FIG. 15. Charged drops 84 are deflected for capture in gutter apparatus 270, 272, 273. Uncharged drops 83 are illustrated flying along an initial trajectory to the receiver surface 300. Semiconductor substrate 511 is mounted on guttered liquid return manifold 274 which is, in turn, mounted on drop emission system support plate 42. A vacuum source 276 is attached (not shown) to the guttered liquid return manifold. Unprinted drops 84 are captured in the gutter apparatus and evacuated for recirculation back through the drop generator 510.

The various drop action apparatus of the liquid drop emission system are not intended to be shown to relative distance scale in FIG. 16. In practice a Coulomb deflection apparatus such as the E-field type illustrated, would be much longer relative to typical stream break-off lengths and charging apparatus electrode lengths in order to develop enough off axis movement to descend below the lip 273 of the drop capturing apparatus.

In analogous fashion to the semiconductor substrates 50 depicted in FIGS. 5 and 6, semiconductor substrates 511 having stream stimulation transducers may also be configured having different positions of drop action apparatus and having different transducer types such as per jet, array-wide or serving groups of jets. The same rationales and discussion of design and device and circuitry fabrication approaches disclosed previously for semiconductor substrates 50 above, apply to analogous semiconductor substrates 511 that are designed for the edgeshooter geometry.

Figure 17A:
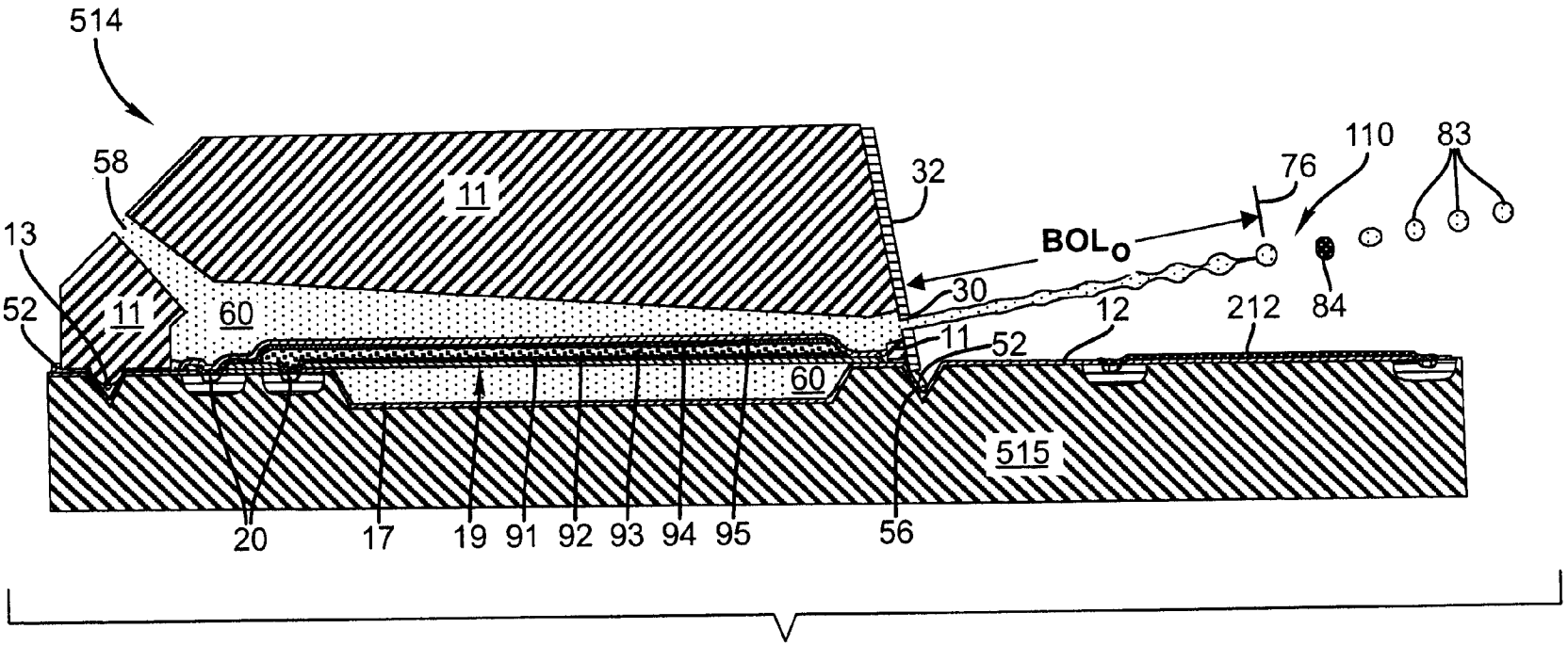
FIGS. 17(*a*) and 17(*b*) are side view illustrations of an edgeshooter style liquid drop emitter having an electromechanical stimulator for each jet.
Figure 17B:
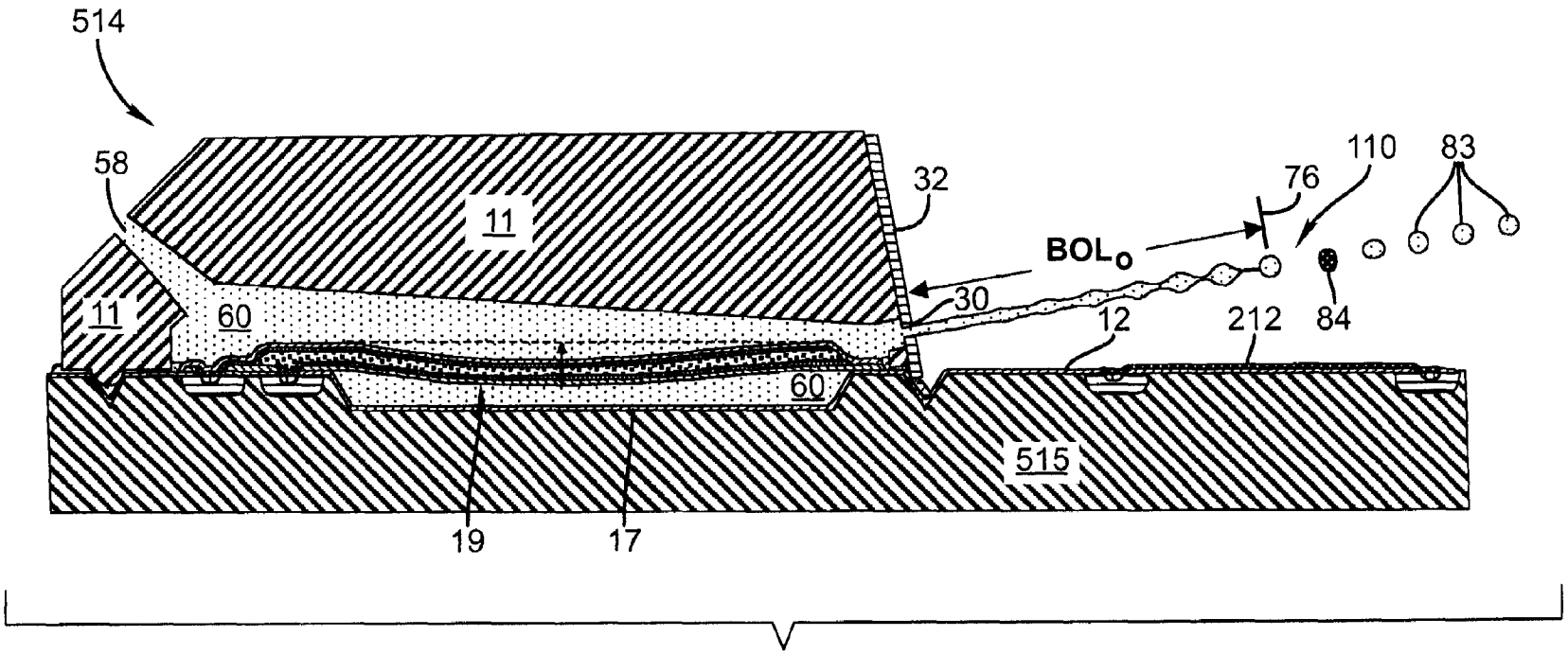

All of the configurations of liquid drop emission apparatus discussed heretofore have employed thermal stimulation heaters to provide jet break-up stimulation. FIGS. 17(*a*) through 20 illustrate alternative embodiments of the present inventions wherein micromechanical transducers are employed to introduce Rayleigh stimulation energy to jets on an individual basis, rather than thermal liquid heaters.

Figure 19A:
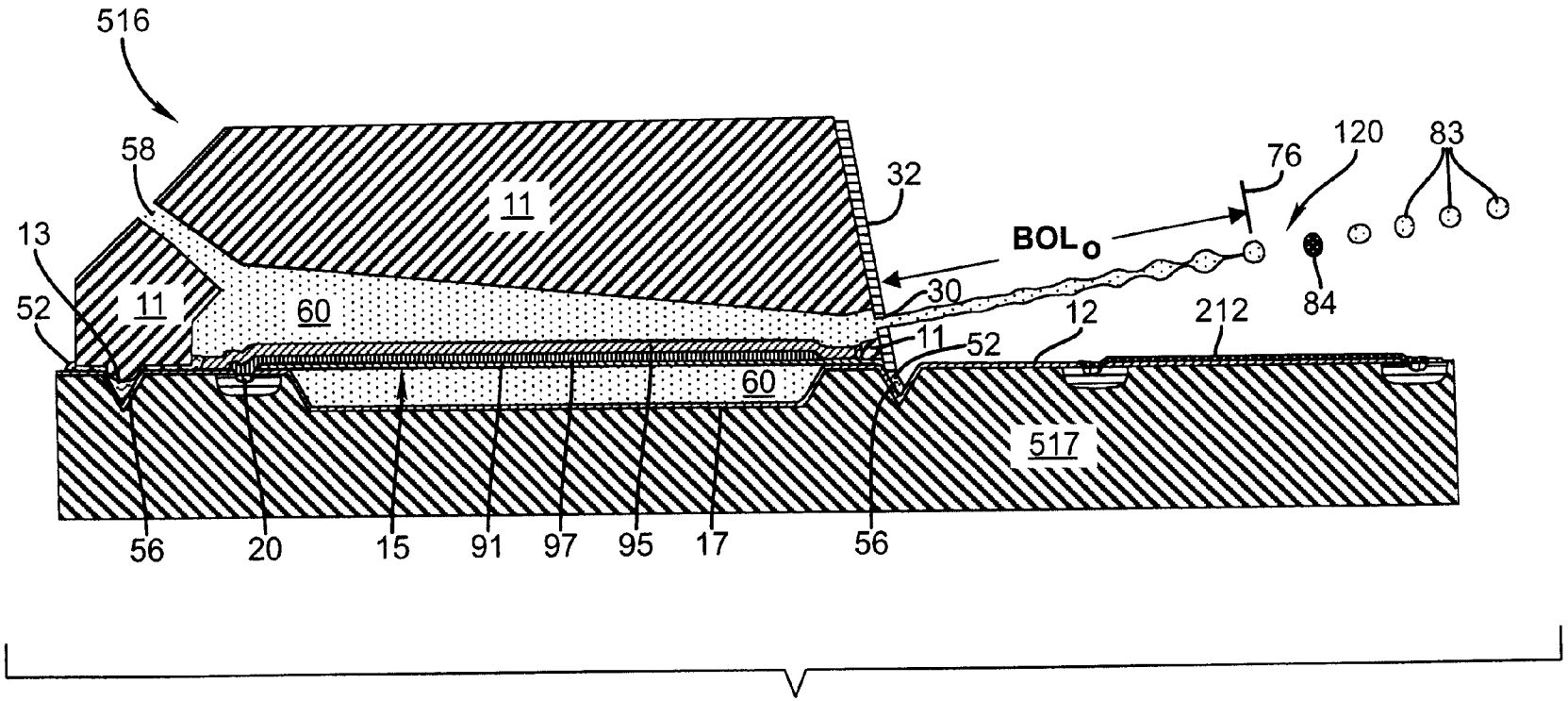
FIGS. 19(*a*) and 19(*b*) are side view illustrations of an edgeshooter style liquid drop emitter having a thermomechanical stimulator for each jet.
Figure 19B:
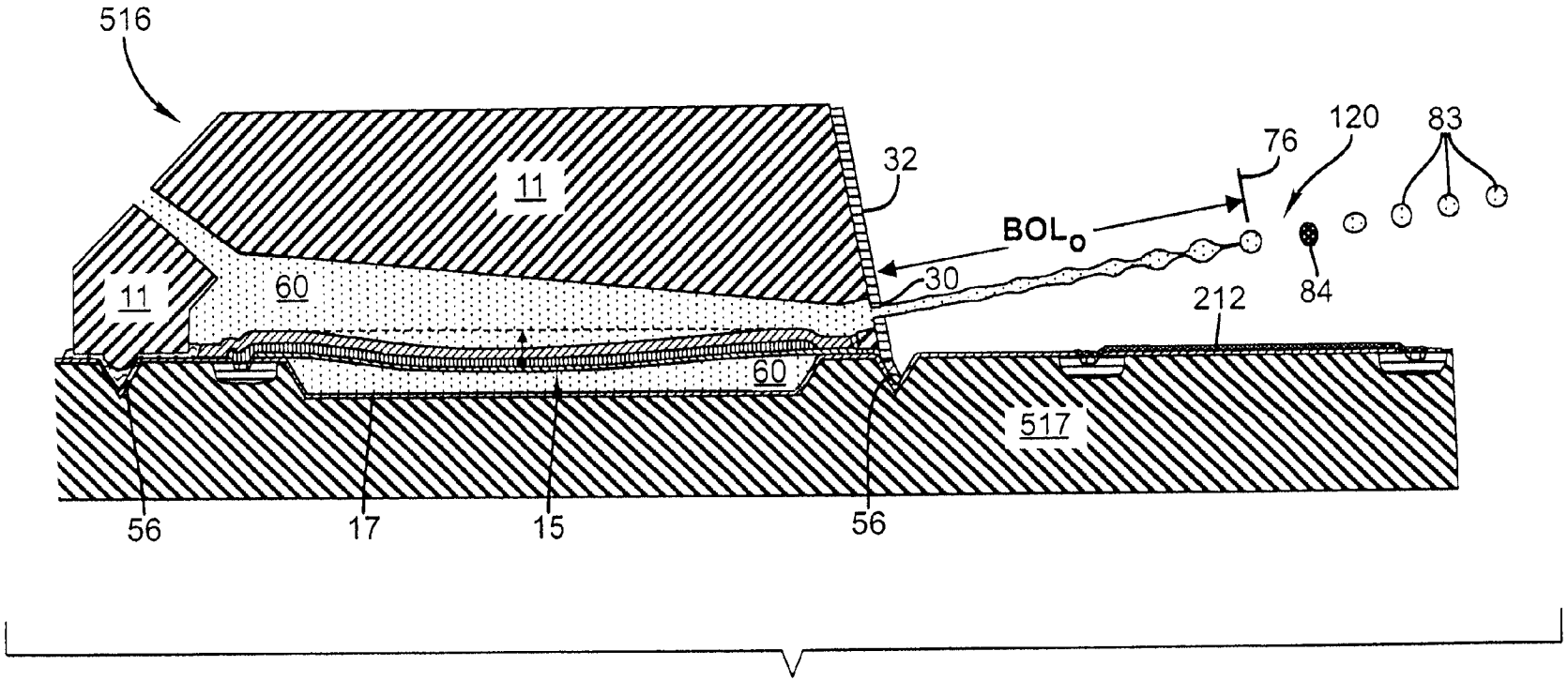

The micromechanical transducers illustrated operate according to two different physical phenomena; however they all function to transduce electrical energy into mechanical motion. The mechanical motion is facilitated by forming each transducer over a cavity so that a flexing and vibrating motion is possible. FIGS. 17(*a*), 17(*b*) and 18 show jet stimulation apparatus based on electromechanical materials that are piezoelectric, ferroelectric or electrostrictive. FIGS. 19(*a*), 19(*b*) and 20 show jet stimulation apparatus based on thermomechanical materials having high coefficients of thermal expansion.

FIGS. 17(*a*) and 17(*b*) illustrate an edgeshooter configuration drop emitter 514 having most of the same functional elements as drop emitter 510 discussed previously and shown in FIG. 13. However, instead of having a resistive heater 18 per jet for stimulating a jet by fluid heating, drop emitter 514 has a plurality of electromechanical beam transducers 19. Semiconductor substrate 515 is formed using microelectronic methods, including the deposition and patterning of an electroactive (piezoelectric, ferroelectric or electrostrictive) material, for example PZT, PLZT or PMNT. Electromechanical beam 19 is a multilayered structure having an electroactive material 92 sandwiched between conducting layers 92, 94 that are, in turn, protected by passivation layers 91, 95 that protect these layers from electrical and chemical interaction with the working fluid 60 of the drop emitter 514. The passivation layers 91, 95 are formed of dielectric materials having a substantial Young's modulus so that these layers act to restore the beam to a rest shape.

A transducer movement cavity 17 is formed beneath each electromechanical beam 19 in substrate 515 to permit the vibration of the beam. In the illustrated configuration, working fluid 60 is allowed to surround the electromechanical beam so that the beam moves against working fluid both above and below its rest position (FIG. 17(*a*)), as illustrated by the arrow in FIG. 17(*b*). An electric field is applied across the electroactive material 93 via conductors above 94 and beneath 92 it and that are connected to underlying MOS circuitry in substrate 515 via contacts 20. When a voltage pulse is applied across the electroactive material 93, the length changes causing the electromechanical beam 19 to bow up or down. Dielectric passivation layers 91, 95 surrounding the conductor 92, 94 and electroactive material 93 layers act to restore the beam to a rest position when the electric field is removed. The dimensions and properties of the layers comprising electromechanical beam 19 may be selected to exhibit resonant vibratory behavior at the frequency desired for jet stimulation and drop generation.

Figure 18:
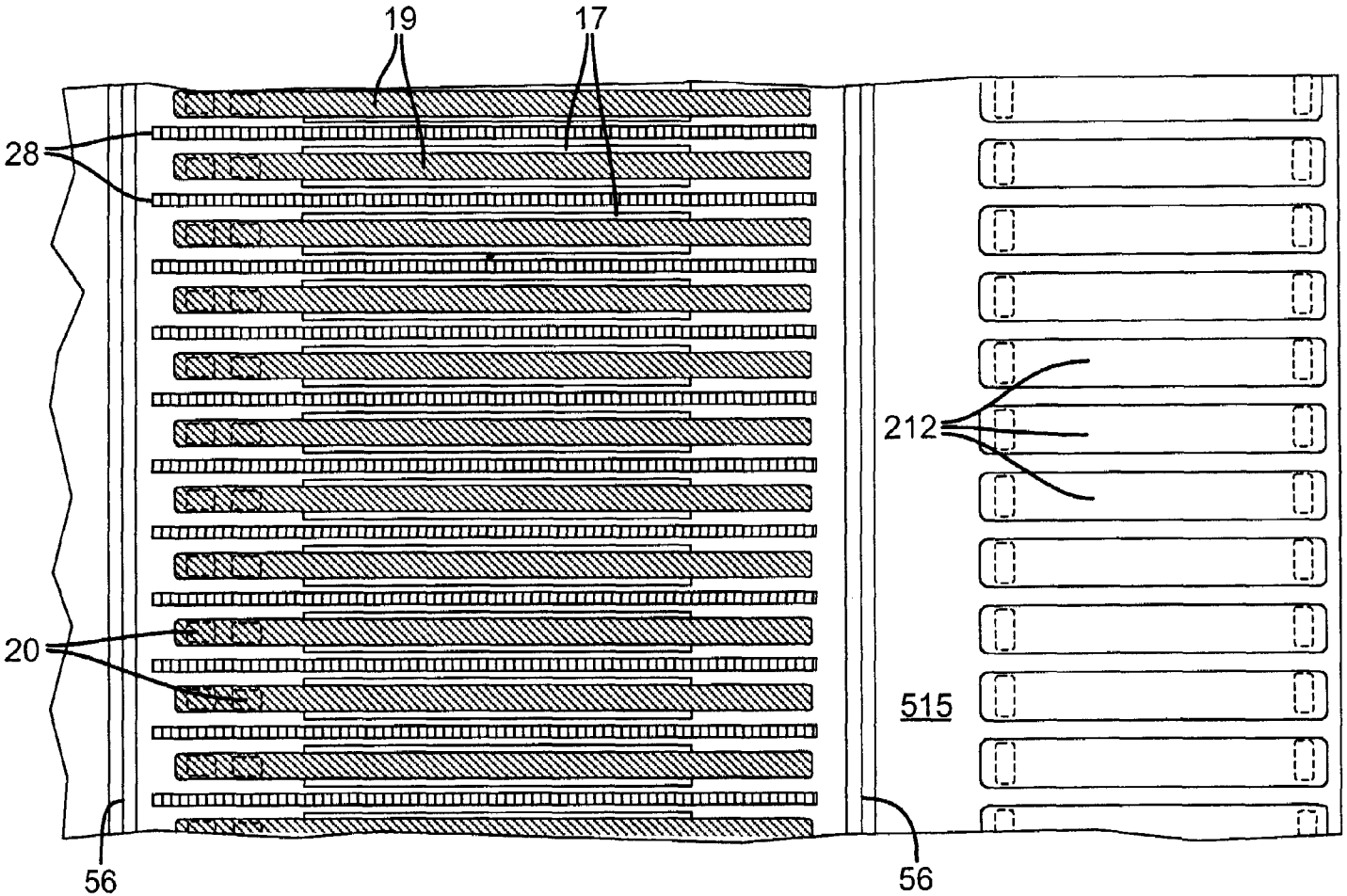
FIG. 18 is a plan view of part of the integrated electromechanical stimulator and drop charger per jet array apparatus.

FIG. 18 illustrates in plan view a portion of semiconductor substrate 515 further illuminating the layout of electromechanical beam transducers 19, flow separation walls 28 and drop charging electrodes 212. The above discussion with respect to FIG. 13, regarding the formation of flow separator walls 28 and positioning of drop charging electrodes 212, applies also to these elements present for drop emitter 514 and semiconductor substrate 515.

Transducer movement cavities 17 are indicated in FIG. 18 by rectangles which are largely obscured by electromechanical beam transducers 19. Each beam transducer 19 is illustrated to have two electrical contacts 20 shown in phantom lines. One electrical contact 20 attaches to an upper conductor layer and the other to a lower conductor layer. The central electroactive material itself is used to electrically isolate the upper conductive layer form the lower in the contact area.

FIGS. 19(*a*) and 19(*b*) illustrate an edgeshooter configuration drop emitter 516 having most of the same functional elements as drop emitter 510 discussed previously and shown in FIG. 13. However, instead of having a resistive heater 18 per jet for stimulating a jet by fluid heating, drop emitter 516 has a plurality of thermomechanical beam transducers 15. Semiconductor substrate 517 is formed using microelectronic methods, including the deposition and patterning of an electroresistive material having a high coefficient of thermal expansion, for example titanium aluminide, as is disclosed by Jarrold et al., U.S. Pat. No. 6,561,627, issued May 13, 2003, assigned to the assignee of the present inventions. Thermomechanical beam 15 is a multilayered structure having an electroresistive material 97 having a high coefficient of thermal expansion sandwiched between passivation layers 91, 95 that protect the electroresistive material layer 97 from electrical and chemical interaction with the working fluid 60 of the drop emitter 516. The passivation layers 91, 95 are formed of dielectric materials having a substantial Young's modulus so that these layers act to restore the beam to a rest shape. In the illustrated embodiment the electroresistive material is formed into a U-shaped resistor through which a current may be passed.

A transducer movement cavity 17 is formed beneath each thermomechanical beam in substrate 517 to permit the vibration of the beam. In the illustrated configuration, working fluid 60 is allowed to surround the thermomechanical beam 15 so that the beam moves against working fluid both above and below its rest position (FIG. 19(*a*)), as illustrated by the arrow in FIG. 19(*b*). An electric field is applied across the electroresistive material via conductors that are connected to underlying MOS circuitry in substrate 517 via contacts 20. When a voltage pulse is applied a current is established, the electroresistive material heats up causing its length to expand and causing the thermomechanical beam 15 to bow up or down. Dielectric passivation layers 91, 95 surrounding the electroresistive material layer 97 act to restore the beam 15 to a rest position when the electric field is removed and the beam cools. The dimensions and properties of the layers comprising thermomechanical beam 15 may be selected to exhibit resonant vibratory behavior at the frequency desired for jet stimulation and drop generation.

Figure 20:
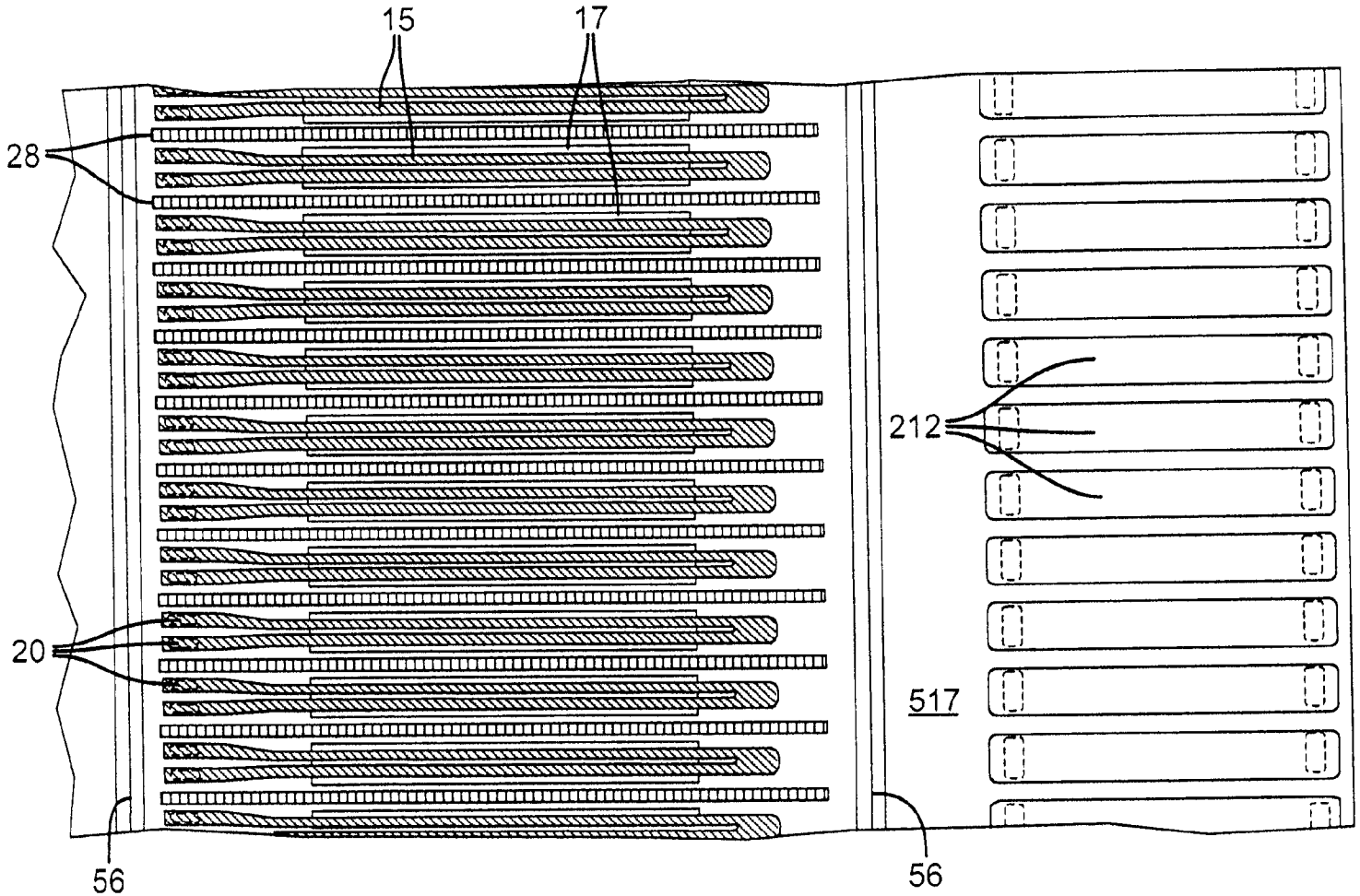
FIG. 20 is a plan view of part of the integrated thermomechanical stimulator and drop charger per jet array apparatus

FIG. 20 illustrates in plan view a portion of semiconductor substrate 517 further illuminating the layout of thermomechanical beam transducers 15, flow separation walls 28 and drop charging electrodes 212. The above discussion with respect to FIG. 13, regarding the formation of flow separator walls 28 and positioning of drop charging electrodes 212, applies also to these elements present for drop emitter 516 and semiconductor substrate 517.

Transducer movement cavities 17 are indicated in FIG. 20 by rectangles which are largely obscured by U-shaped thermomechanical beam transducers 15. Each beam transducer 15 is illustrated to have two electrical contacts 20. While FIG. 14 illustrates a U-shape for the beam itself, in practice only the electroresistive material, for example titanium aluminide, is patterned in a U-shape by the removal of a central slot of material. Dielectric layers, for example silicon oxide, nitride or carbide, are formed above and beneath the electroresistive material layer and pattered as rectangular beam shapes without central slots. The electroresistive material itself is brought into contact with underlying MOS circuitry via contacts 20 so that voltage (current) pulses may be applied to cause individual thermomechanical beams 15 to vibrate to stimulate individual jets.

Figure 21:
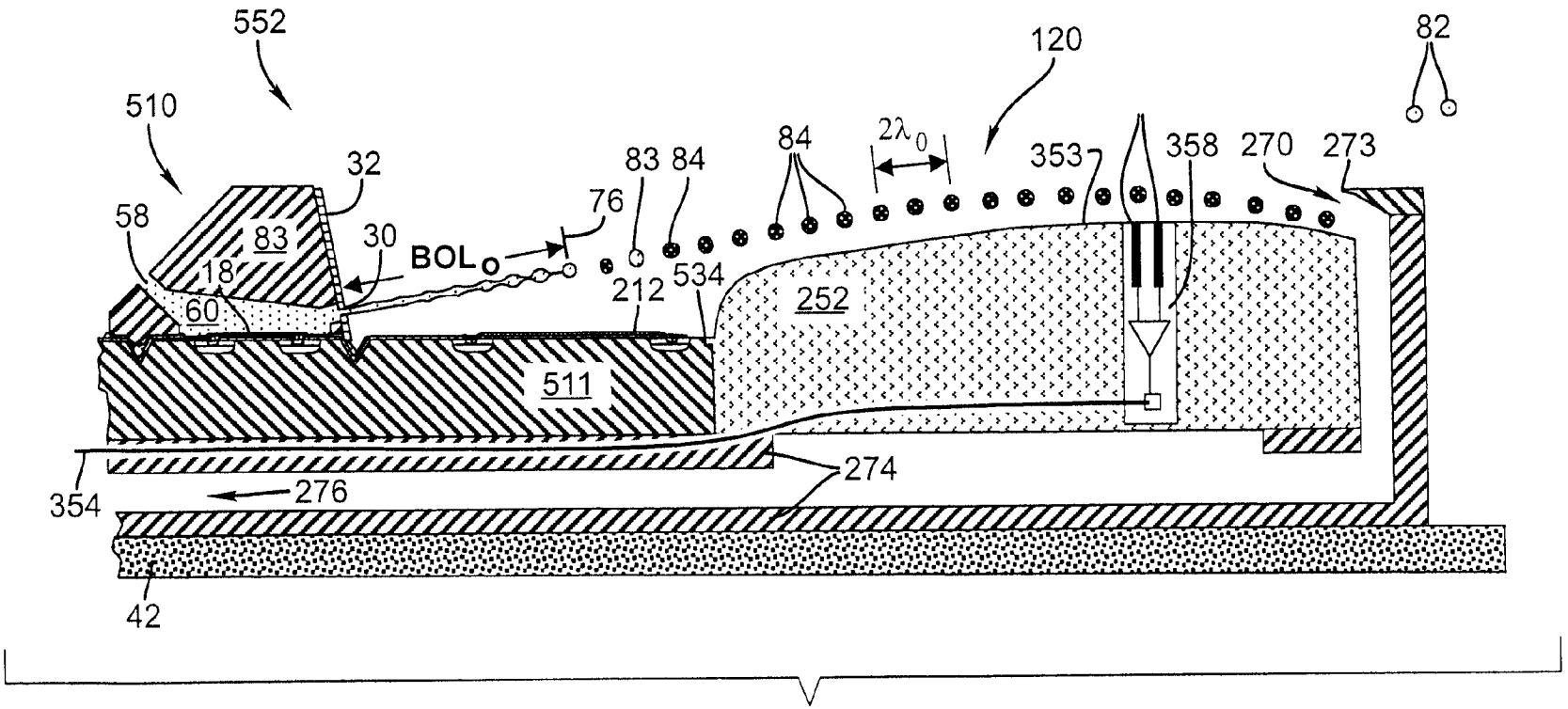
FIG. 21 is a side view illustration of an edgeshooter style liquid drop emitter as shown in FIG. 13 further illustrating the location of separate apparatus for drop deflection, guttering and optical sensing according to the present inventions.

FIG. 21 illustrates, in side view of one jet and stream of drops 120, a liquid drop emission system 552 assembled on system support 42 comprising a drop emitter 510 of the edgeshooter type shown in FIG. 13. Drop emitter 510 with integrated inductive charging apparatus and MOS circuitry is further combined with a ground-plane style drop deflection apparatus 252, drop gutter 270 and drop sensing apparatus 358. Gutter liquid return manifold 274 is connected to a vacuum source (not shown indicated as 276) that withdraws liquid that accumulates in the gutter from drops tat are not used to form the desired pattern at receiver plane 300. The ground plane deflection apparatus is located with respect to drop generator 510 by means of location features 534 formed on semiconductor substrate 511.

Ground plane drop deflection apparatus 252 is a conductive member held at ground potential. Charged drops flying near to the grounded conductor surface induce a charge pattern of opposite sign in the conductor, a so-called "charge image" that attracts the charged drop. That is, a charged drop flying near a conducting surface is attracted to that surface by a Coulomb force that is approximately the force between itself and an oppositely charged drop image located behind the conductor surface an equal distance. Ground plane drop deflector 252 is shaped to enhance the effectiveness of this image force by arranging the conductor surface to be near the drop stream shortly following jet break-off. Charged drops 84 are deflected by their own image force to follow the curved path illustrated to be captured by gutter lip 273 or to land on the surface of deflector 252 and be carried into the vacuum region by their momentum. Ground plane deflector 252 also may be usefully made of sintered metal, such as stainless steel and communicated with the vacuum region of gutter manifold 274 as illustrated.

Uncharged drops are not deflected by the ground plane deflection apparatus 252 and travel along an initial trajectory toward the receiver plane 300 as is illustrated for a two drop pair 82. Drop sensing apparatus 358 is located along the surface 353 of deflection ground plane 252 which also serves as a landing surface for drop that are deflected for guttering. Such gutter landing surface drop sensors are disclosed by Piatt, et al. in U.S. Pat. No. 4,631,550, issued Dec. 23, 1986.

Drop sensing apparatus 358 is comprised of sensor electrodes 356 that are connected to amplifier electronics. When charged drops land in proximity to the sensor electrodes a voltage signal may be detected. Alternately, sensor electrodes 356 may be held at a differential voltage and the presence of a conducting working fluid is detected by the change in a base resistance developed along the path between the sensor electrodes. Drop sensor apparatus 358 is a schematic representation of an individual sensor, however it is contemplated that a sensor serving an array of jets may have a set of sensor electrode and signal electronics for every jet, or for a group of jets, or even a single set that spans the full array width and serves all jets of the array. Drop sensor apparatus sensor signal lead 354 is shown schematically routed beneath drop emitter semiconductor substrate 511. It will be appreciated by those skilled in the ink jet art that many other configurations of the sensor elements are possible, including routing the signal lead to circuitry within semiconductor substrate 511.

Figure 22A:
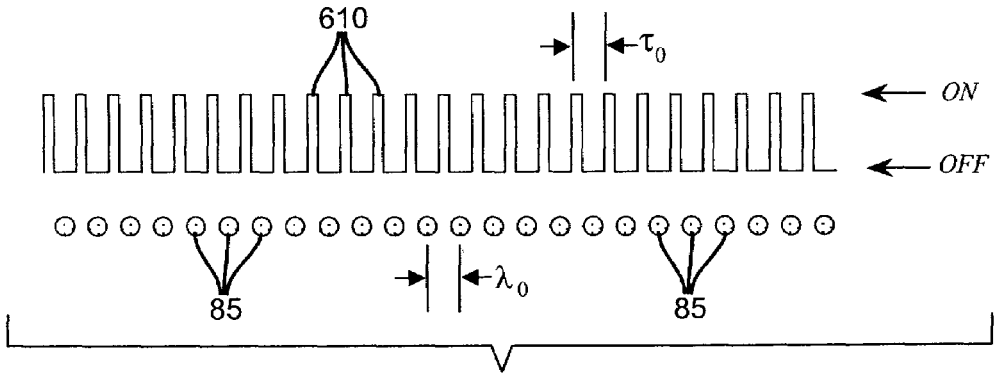
FIGS. 22(*a*), 22(*b*) and 22(*c*) illustrate electrical and thermal pulse sequences and the resulting stream break-up into drops of predetermined volumes according to the present inventions.
Figure 22B:
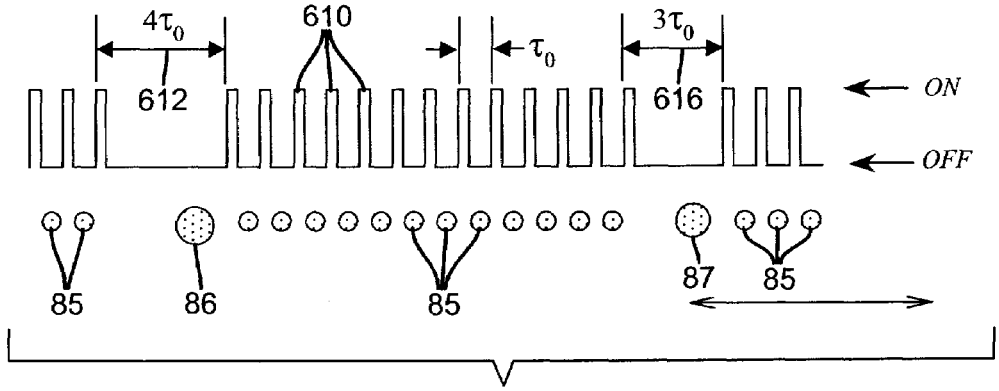
Figure 22C:
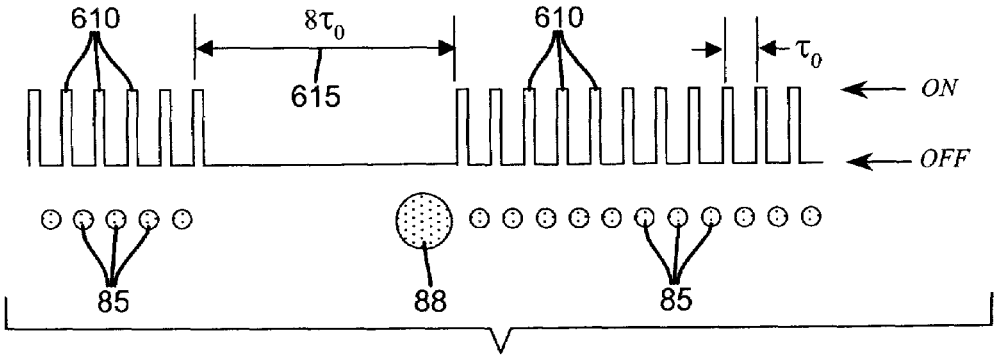

Thermal pulse synchronization of the break-up of continuous liquid jets is known to provide the capability of generating streams of drops of predetermined volumes wherein some drops may be formed having integer, m, multiple volumes, $mV_0$, of a unit volume, $V_0$. See for example U.S. Pat. No. 6,588,888 to Jeanmaire, et al. and assigned to the assignee of the present inventions. FIGS. 22(*a*)-22(*c*) illustrate thermal stimulation of a continuous stream by several different sequences of electrical energy pulses. The energy pulse sequences are represented schematically as turning a heater resistor "on" and "off" at during unit periods, $\tau_0$.

In FIG. 22(*a*) the stimulation pulse sequence consists of a train of unit period pulses 610. A continuous jet stream stimulated by this pulse train is caused to break up into drops 85 all of volume $V_0$, spaced in time by $\tau_0$ and spaced along their flight path by $\lambda_0$. The energy pulse train illustrated in FIG. 22(*b*) consists of unit period pulses 610 plus the deletion of some pulses creating a $4\tau_0$ time period for sub-sequence 612 and a $3\tau_0$ time period for sub-sequence 616. The deletion of stimulation pulses causes the fluid in the jet to collect into drops of volumes consistent with these longer that unit time periods. That is, subsequence 612 results in the break-off of a drop 86 having volume $4V_0$ and subsequence 616 results in a drop 87 of volume $3V_0$. FIG. 22(*c*) illustrates a pulse train having a sub-sequence of period $8\tau_0$ generating a drop 88 of volume $8V_0$.

The capability of producing drops in multiple units of the unit volume $V_0$ may be used to advantage in liquid drop emission control apparatus by providing a means of "tagging" the break-off event with a differently-sized drop or a predetermined pattern of drops of different volumes. That is, drop volume may be used in analogous fashion to the patterns of charged and uncharged drops to assist in the measurement of drop stream characteristics. Drop sensing apparatus may be provided capable of distinguishing between unit volume and integer multiple volume drops. The thermal stimulation pulse sequences applied to each jet of a plurality of jets can have thermal pulse sub-sequences that create predetermined patterns of drop volumes for a specific jet that is being measured whereby other jets receive a sequence of only unit period pulses.

The inventions have been described in detail with particular reference to certain preferred embodiments thereof, but it will be understood that variations and modifications can be effected within the spirit and scope of the inventions.

PARTS LIST

10 substrate for heater resistor elements and MOS circuitry
11 drop generator chamber and flow separation member
12 insulator layer
13 assembly location feature formed on drop generator chamber member 11
14 passivation layer
15 thermo-mechanical stimulator, one per jet
16 interconnection conductor layer
17 movement cavity beneath microelectromechanical stimulator
18 resistive heater for thermal stimulation via liquid heating
19 piezo-mechanical stimulator, one per jet
20 contact to underlying MOS circuitry
22 common current return electrical conductor
24 underlying MOS circuitry for heater apparatus
28 flow separator
30 nozzle opening
32 nozzle plate
40 pressurized liquid supply manifold
42 liquid drop emission system support
44 pressurized liquid inlet in phantom view
46 strength members formed in substrate 10
48 pressurized liquid supply chamber
50 microelectronic integrated drop charging and sensing apparatus
51 microelectronic integrated drop sensing apparatus
52 bonding layer joining components
54 insulating layer
55 alignment feature provided in the semiconductor substrate
56 alignment feature provided in the semiconductor substrate
58 inlet to drop generator chamber for supplying pressurized liquid
60 positively pressurized liquid
62 continuous stream of liquid
64 natural surface waves on the continuous stream of liquid
66 drops of undetermined volume
70 stimulated surface waves on the continuous stream of liquid
76 operating break-off length
77 natural break-off length
80 drops of predetermined volume
82 drop pair used for drop arrival measurement
83 uncharged drop(s)
84 inductively charged drop(s)
85 drop(s) having the predetermined unit volume $V_o$
86 drop(s) having volume $mV_o$, m=4
87 drop(s) having volume $mV_o$, m=3
88 drop(s) having volume $mV_o$, m=8
89 inductively charged drop(s) having volume $mV_o$, m=4
91 dielectric and chemical passivation layer
92 electrically conducting layer
93 electroactive material, for example, PZT, PLZT or PMNT
94 electrically conducting layer
95 thermomechanical material, for example, titanium aluminide
100 stream of drops of undetermined volume from natural break-up
120 stream of drops of predetermined volume and operating break-off length
200 schematic drop charging apparatus
202 underlying MOS circuitry for inductive charging apparatus
204 contact to underlying MOS circuitry
206 underlying MOS circuitry for inductive charging apparatus
208 contact to underlying MOS circuitry
210 charging electrode for inductively charging stream 62
212 inductive charging apparatus elements, one per jet
214 inductive charging apparatus elements, one per group of jets
226 gap between first and second electrodes of charged drop sensor
230 schematic drop sensing apparatus
231 array wide electrostatic drop sensor
232 first array wide electrode of a charged drop sensor
233 contact to underlying MOS circuitry
234 underlying MOS circuitry for drop sensing apparatus
235 sensor site of a sensor-per-jet drop sensing apparatus
236 underlying MOS circuitry for drop sensing apparatus
237 contact to underlying MOS circuitry

238 second array wide electrode of a charged drop sensor
250 Coulomb force deflection apparatus
251 array wide drop deflector electrode
252 porous conductor ground plane deflection apparatus
254 high voltage electrode of a Coulomb force deflection apparatus
255 underlying MOS circuitry for deflection apparatus
256 aerodynamic cross flow deflection zone
270 gutter opening to capture drops not used for deposition on the receiver
272 etched groove drop landing and capture surface
273 lip of drop capture gutter
274 guttered liquid return manifold
275 liquid blob at drop capture surface
276 to vacuum source providing negative pressure to gutter return manifold
280 drop illumination source
281 contact lead to optical drop sensor 283
282 light impinging on test drop pair 82
284 drop shadow cast on optical detector
287 light energy refracted by the illuminated liquid stream
290 multi-element light sensor
292 connection of optical detector 290 to electronics in substrate 50
298 pulsed stream illumination source
300 print or drop deposition plane
310 signal processing amplifier, low noise or phase sensitive
356 drop impact sensor located on gutter landing surface
358 drop sensor signal processing circuitry
500 liquid drop emitter having a plurality of jets or drop streams
510 edgeshooter configuration drop emitter and individual heaters per jet
511 integrated heaters per jet and drop charging apparatus
514 drop emitter having an individual piezo-mechanical stimulator per jet
515 integrated piezo-mechanical stimulators and drop charging apparatus
516 drop emitter having an individual thermo-mechanical stimulator per jet
517 integrated thermo-mechanical stimulators and drop charging apparatus
530 thick organic passivation and location feature layer
610 representation of stimulation thermal pulses for drops 85
612 representation of deleted stimulation thermal pulses for drop 86
615 representation of deleted stimulation thermal pulses for drop 88
616 representation of deleted stimulation thermal pulses for drop 87

The invention claimed is:

1. A continuous liquid drop emission apparatus comprising:

a liquid chamber containing a positively pressurized liquid in flow communication with at least one nozzle for emitting a continuous stream of liquid;

a jet stimulation apparatus adapted to transfer energy to the liquid in flow communication with the at least one nozzle sufficient to cause the break-off of the at least one continuous stream of liquid into a stream of drops of predetermined volumes;

a semiconductor substrate including drop action apparatus and integrated circuitry formed therein for performing and controlling a plurality of actions on the drops of predetermined volumes, said semiconductor substrate extending to position the drop action generator adjacent to the stream of drops of predetermined volumes in order to perform the plurality of actions.

2. The continuous liquid drop emission apparatus of claim 1 wherein the jet stimulation apparatus comprises resistive heater apparatus adapted transfer thermal energy to the liquid in flow communication with the at least one nozzle.

3. The continuous liquid drop emission apparatus of claim 2 wherein the resistive heater apparatus is comprised of poly-silicon resistors.

4. The continuous liquid drop emission apparatus of claim 1 wherein the jet stimulation apparatus comprises electromechanical device apparatus adapted to transfer mechanical energy to the liquid in flow communication with the at least one nozzle.

5. The continuous liquid drop emission apparatus of claim 4 wherein the electromechanical device apparatus is comprised of a piezoelectric material.

6. The continuous liquid drop emission apparatus of claim 1 wherein the jet stimulation apparatus comprises thermomechanical device apparatus adapted to transfer mechanical energy to the liquid in flow communication with the at least one nozzle.

7. The continuous liquid drop emission apparatus of claim 6 wherein thermomechanical device apparatus comprises a titanium aluminide material.

8. The continuous liquid drop emission apparatus of claim 1 wherein the plurality of actions includes charging at least one drop and the drop action apparatus is a charging apparatus adapted to inductively charge the drops of predetermined volume is formed on the semiconductor substrate.

9. The continuous liquid drop emission apparatus of claim 1 wherein the plurality of actions includes sensing at least one drop and the drop action apparatus is a sensing apparatus adapted to sense the drops of predetermined volume is formed on the semiconductor substrate.

10. The continuous liquid drop emission apparatus of claim 9 wherein the sensing apparatus is comprised of optical detector apparatus adapted to sense a shadow of the at least one drop.

11. The continuous liquid drop emission apparatus of claim 9 wherein the sensing apparatus is comprised of impact detector apparatus adapted to sense an impact of the at least one drop.

12. The continuous liquid drop emission apparatus of claim 9 wherein the drop action apparatus further comprises charging apparatus adapted to inductively charge the drops of predetermined volume and wherein the sensing apparatus is comprised of charge detector apparatus adapted to sense a charge of the at least one drop.

13. The continuous liquid drop emission apparatus of claim 8 wherein the plurality of actions further comprises deflecting the at least one drop and the drop action apparatus is an electrostatic drop deflection apparatus adapted to apply a Coulomb force is formed on the semiconductor substrate.

14. The continuous liquid drop emission apparatus of claim 1 wherein the plurality of actions includes capturing at least one drop and the drop action apparatus is a drop capturing apparatus adapted to capture the at least one drop is formed on the semiconductor substrate.

15. The continuous liquid drop emission apparatus of claim 1 further comprising location features formed on the semiconductor substrate for use in aligning additional subsystem apparatus components with respect to the semiconductor substrate.

16. The continuous liquid drop emission apparatus of claim 15 the additional subsystem apparatus components includes the liquid chamber.

17. The continuous liquid drop emission apparatus of claim 1 wherein the semiconductor substrate is comprised of at least silicon.

18. The continuous liquid drop emission apparatus of claim 1 wherein the integrated circuitry is comprised of at least CMOS circuitry.

19. The continuous liquid drop emission apparatus of claim 1 wherein the integrated circuitry is comprised of at least NMOS circuitry.

20. The continuous liquid drop emission apparatus of claim 1 wherein the predetermined volumes of drops include drops of a unit volume, $V_0$, and drops having volumes that are integer multiples of the unit volume, $mV_0$, wherein m is an integer.

21. The continuous liquid drop emission apparatus of claim 1 wherein the liquid is an ink and the continuous liquid drop emission apparatus is an ink jet printhead.

22. The continuous liquid drop emission apparatus of claim 1 wherein the energy is transferred to the liquid as a series of pulses.

23. The continuous liquid drop emission apparatus of claim 1 wherein the energy is transferred to the liquid as a waveform comprised of at least a sine wave.

24. A continuous liquid drop emission apparatus comprising:

a liquid chamber containing a positively pressurized liquid in flow communication with at least one nozzle for emitting a continuous stream of liquid;

a jet stimulation apparatus adapted to transfer energy to the liquid in flow communication with the at least one nozzle sufficient to cause the break-off of the at least one continuous stream of liquid into a stream of drops of predetermined volumes;

a semiconductor substrate including drop action apparatus and integrated circuitry formed therein for performing and controlling a plurality of actions on the drops of predetermined volumes, the semiconductor substrate extending to position the drop action generator adjacent to the stream of drops of predetermined volumes in order to perform the plurality of actions, the semiconductor substrate including location features formed on the semiconductor substrate for use in aligning additional subsystem apparatus components with respect to the semiconductor substrate.

25. The continuous liquid drop emission apparatus of claim 24 wherein the additional subsystem apparatus components includes the liquid chamber.

26. The continuous liquid drop emission apparatus of claim 24 wherein the semiconductor substrate is comprised of at least silicon.

27. The continuous liquid drop emission apparatus of claim 24 wherein the integrated circuitry is comprised of at least CMOS circuitry.

28. The continuous liquid drop emission apparatus of claim 24 wherein the predetermined volumes of drops include drops of a unit volume, $V_0$, and drops having volumes that are integer multiples of the unit volume, $mV_0$, wherein m is an integer.

29. The continuous liquid drop emission apparatus of claim 24 wherein the liquid is an ink and the continuous liquid drop emission apparatus is an ink jet printhead.

30. The continuous liquid drop emission apparatus of claim 24 wherein the energy is transferred to the liquid as a waveform comprised of at least a sine wave.

31. The continuous liquid drop emission apparatus of claim 24 wherein the jet stimulation apparatus comprises resistive heater apparatus adapted transfer thermal energy to the liquid in flow communication with the at least one nozzle.

32. The continuous liquid drop emission apparatus of claim 31 wherein the resistive heater apparatus is comprised of poly-silicon resistors.

33. The continuous liquid drop emission apparatus of claim 24 wherein the plurality of actions includes sensing at least one drop and the drop action apparatus is a sensing apparatus adapted to sense the drops of predetermined volume is formed on the semiconductor substrate.

34. The continuous liquid drop emission apparatus of claim 33 wherein the sensing apparatus is comprised of optical detector apparatus adapted to sense a shadow of the at least one drop.

35. The continuous liquid drop emission apparatus of claim 33 wherein the sensing apparatus is comprised of impact detector apparatus adapted to sense an impact of the at least one drop.

36. A continuous liquid drop emission apparatus comprising:

a liquid chamber containing a positively pressurized liquid in flow communication with at least one nozzle for emitting a continuous stream of liquid;

a jet stimulation apparatus adapted to transfer energy to the liquid in flow communication with the at least one nozzle sufficient to cause the break-off of the at least one continuous stream of liquid into a stream of drops of predetermined volumes;

a semiconductor substrate including drop action apparatus and integrated circuitry formed therein for performing and controlling a plurality of actions on the drops of predetermined volumes, the semiconductor substrate extending to position the drop action generator adjacent to the stream of drops of predetermined volumes in order to perform the plurality of actions, the semiconductor substrate being comprised of at least silicon.

37. The continuous liquid drop emission apparatus of claim 36 further comprising location features formed on the semiconductor substrate for use in aligning additional subsystem apparatus components with respect to the semiconductor substrate.

38. The continuous liquid drop emission apparatus of claim 37 wherein the additional subsystem apparatus components includes the liquid chamber.

39. The continuous liquid drop emission apparatus of claim 36 wherein the integrated circuitry is comprised of at least CMOS circuitry.

40. The continuous liquid drop emission apparatus of claim 36 wherein the predetermined volumes of drops include drops of a unit volume, $V_0$, and drops having volumes that are integer multiples of the unit volume, $mV_0$, wherein m is an integer.

41. The continuous liquid drop emission apparatus of claim 36 wherein the liquid is an ink and the continuous liquid drop emission apparatus is an ink jet printhead.

42. The continuous liquid drop emission apparatus of claim 36 wherein the energy is transferred to the liquid as a waveform comprised of at least a sine wave.

43. The continuous liquid drop emission apparatus of claim 36 wherein the jet stimulation apparatus comprises resistive heater apparatus adapted transfer thermal energy to the liquid in flow communication with the at least one nozzle.

44. The continuous liquid drop emission apparatus of claim 43 wherein the resistive heater apparatus is comprised of poly-silicon resistors.

45. The continuous liquid drop emission apparatus of claim 36 wherein the plurality of actions includes sensing at least one drop and the drop action apparatus is a sensing apparatus adapted to sense the drops of predetermined volume is formed on the semiconductor substrate.

46. The continuous liquid drop emission apparatus of claim 45 wherein the sensing apparatus is comprised of optical detector apparatus adapted to sense a shadow of the at least one drop.

47. The continuous liquid drop emission apparatus of claim 45 wherein the sensing apparatus is comprised of impact detector apparatus adapted to sense an impact of the at least one drop.

* * * * *